US009322150B2

(12) United States Patent
Johnston et al.

(10) Patent No.: US 9,322,150 B2
(45) Date of Patent: Apr. 26, 2016

(54) WEAR ASSEMBLY

(71) Applicant: ESCO Corporation, Portland, OR (US)

(72) Inventors: Christopher A. Johnston, Portland, OR (US); Donald M. Conklin, Lake Oswego, OR (US); Michael B. Roska, Portland, OR (US); William D. Rossi, Portland, OR (US); Kevin S. Stangeland, Portland, OR (US)

(73) Assignee: ESCO CORPORATION, Portland, OR (US)

( * ) Notice: Subject to any disclaimer, the term of this patent is extended or adjusted under 35 U.S.C. 154(b) by 113 days.

(21) Appl. No.: 14/249,894

(22) Filed: Apr. 10, 2014

(65) Prior Publication Data

US 2014/0215868 A1 Aug. 7, 2014

Related U.S. Application Data

(63) Continuation of application No. PCT/US2012/065689, filed on Nov. 16, 2012.

(60) Provisional application No. 61/720,928, filed on Oct. 31, 2012, provisional application No. 61/563,448, filed on Nov. 23, 2011.

(51) Int. Cl.
*E02F 9/28* (2006.01)

(52) U.S. Cl.
CPC ..... *E02F 9/2816* (2013.01); *E02F 9/2825* (2013.01); *E02F 9/2841* (2013.01); *E02F 9/2858* (2013.01)

(58) Field of Classification Search
CPC ..... E02F 9/2816; E02F 9/2525; E02F 9/2833
USPC ..... 37/455, 456
See application file for complete search history.

(56) References Cited

U.S. PATENT DOCUMENTS

| | | | | |
|---|---|---|---|---|
| 2,064,059 | A * | 12/1936 | Fellmeth | E02F 9/2825 37/456 |
| 4,067,657 | A | 1/1978 | Kaarlela | |
| 4,748,754 | A | 6/1988 | Schwappach | |
| 5,435,084 | A | 7/1995 | Immel | |
| 5,718,070 | A | 2/1998 | Ruvang | |
| 5,833,323 | A | 11/1998 | Massa et al. | |
| 5,913,605 | A | 6/1999 | Jusselin et al. | |
| 5,983,534 | A | 11/1999 | Robinson et al. | |
| 5,987,787 | A | 11/1999 | Mack | |
| 5,992,063 | A | 11/1999 | Mack | |
| 6,085,448 | A | 7/2000 | Gale | |
| 6,108,950 | A | 8/2000 | Ruvang et al. | |
| 6,216,368 | B1 | 4/2001 | Bierwith | |
| 6,393,738 | B1 | 5/2002 | Bierwith | |

(Continued)

FOREIGN PATENT DOCUMENTS

WO WO 2003/004782 1/2003

*Primary Examiner* — Gary Hartmann
(74) *Attorney, Agent, or Firm* — John Anderton

(57) ABSTRACT

Wear members for wear assemblies include a lock configured to secure the wear member to a base, where the lock has two engagement positions, namely: (a) a first position that secures the lock to the wear member, and (b) a second position that secures the wear member to the base. The locks are further configured to be unlatched and removed from the wear member in two phases, a first retraction of the latching mechanism, followed by a rotation of the lock itself with removal from the wear member.

24 Claims, 31 Drawing Sheets

(56) References Cited

U.S. PATENT DOCUMENTS

| | | | | |
|---|---|---|---|---|
| 6,415,533 | B2 | 7/2002 | Bierwith | |
| 6,439,796 | B1 | 8/2002 | Ruvang et al. | |
| 6,668,472 | B2 | 12/2003 | Bierwith | |
| 6,675,509 | B2 | 1/2004 | Bierwith | |
| 6,708,431 | B2 | 3/2004 | Robinson et al. | |
| 6,826,855 | B2 | 12/2004 | Ruvang | |
| 6,871,426 | B2 | 3/2005 | Keech | |
| 6,976,325 | B2 | 12/2005 | Robinson et al. | |
| 7,121,022 | B2 | 10/2006 | Bierwith | |
| 7,121,023 | B2 | 10/2006 | Robinson et al. | |
| 7,162,818 | B2 | 1/2007 | Ruvang et al. | |
| 7,603,799 | B2 | 10/2009 | Campomanes | |
| 7,690,137 | B2 | 4/2010 | Pasqualini | |
| 7,707,755 | B2 | 5/2010 | Lopez Almendros et al. | |
| 7,762,015 | B2 | 7/2010 | Smith et al. | |
| 7,788,830 | B2 | 9/2010 | Woerman et al. | |
| 7,862,277 | B2 | 1/2011 | Dingwall et al. | |
| 7,874,086 | B2 | 1/2011 | Briscoe et al. | |
| 7,882,649 | B2 | 2/2011 | Carpenter et al. | |
| 7,926,207 | B2 | 4/2011 | Lopez Almendros et al. | |
| 7,980,011 | B2 | 7/2011 | Ruvang | |
| 8,720,087 | B2 * | 5/2014 | Briscoe | E02F 9/2841 37/456 |
| 8,832,975 | B2 * | 9/2014 | Itou | E02F 9/2833 37/455 |
| 2003/0070330 | A1 | 4/2003 | Olds et al. | |
| 2005/0028407 | A1 | 2/2005 | Ruvang et al. | |
| 2005/0229443 | A1 | 10/2005 | Bierwith | |
| 2007/0204490 | A1 | 9/2007 | Jones et al. | |
| 2008/0092413 | A1 | 4/2008 | McClanahan et al. | |
| 2008/0209772 | A1 | 9/2008 | Cui | |
| 2009/0205227 | A1 | 8/2009 | Stewart et al. | |
| 2009/0320333 | A1 | 12/2009 | Martinez et al. | |
| 2010/0115804 | A1 | 5/2010 | Lopez Almendros et al. | |
| 2010/0170119 | A1 | 7/2010 | Lopez Almendros et al. | |
| 2011/0000109 | A1 | 1/2011 | Woerman et al. | |
| 2011/0030247 | A1 | 2/2011 | Ruvang | |
| 2011/0035970 | A1 | 2/2011 | Smith et al. | |
| 2011/0035971 | A1 | 2/2011 | Smith et al. | |
| 2011/0035972 | A1 | 2/2011 | Harder et al. | |
| 2011/0252672 | A1 | 10/2011 | Briscoe et al. | |
| 2015/0368884 | A1 * | 12/2015 | Cheyne | E02F 9/2841 37/453 |

* cited by examiner

WEAR ASSEMBLY

RELATED APPLICATION DATA

This application claims priority benefits based on U.S. Provisional Patent Appln. No. 61/563,448, filed Nov. 23, 2011 and entitled "Wear Assembly," and U.S. Provisional Patent Appln. No. 61/720,928, filed Oct. 31, 2012 and entitled "Wear Assembly." Each of these priority applications is entirely incorporated herein by reference in its entirety.

FIELD OF THE DISCLOSURE

This disclosure pertains to wear assemblies for ground-engaging equipment, and to the wear members, bases and locks of the wear assemblies.

BACKGROUND OF THE DISCLOSURE

Excavating equipment, such as excavating buckets, cutterheads, and the like, are used for demolition, mining, earth moving, and other similarly harsh applications. To protect the equipment from wear and/or to enhance the operation of the equipment, wear parts may be attached to the excavating equipment. Such wear parts may include points, adapters, shrouds, runners, and the like.

Such wear parts are commonly subjected to harsh conditions, heavy loading, and extreme abrasion. Accordingly, the wear parts wear down over time and must be replaced, often in the field and under less than ideal conditions.

It is common for a lock to be used to releasably secure a wear member to a base. To do so, the lock must therefore satisfy several seemingly contradictory requirements. The lock must secure the wear member to the base with sufficient strength and stability to avoid failure during operation. At the same time, the lock must facilitate release and replacement of the wear member by field personnel, under field conditions.

Examples of wear parts and their retaining devices are disclosed in U.S. Pat. No. 5,709,043, U.S. Pat. No. 6,735,890, U.S. Pat. No. 6,871,426, U.S. Pat. No. 6,986,216, U.S. Pat. No. 6,993,861, U.S. Pat. No. 7,121,022, U.S. Pat. No. 7,367,144, and U.S. Pat. No. 7,882,649; and U.S. Patent Publication Nos. US20110107624. The disclosures of these and all other publications referenced herein are incorporated by reference in their entirety for all purposes.

SUMMARY OF THE DISCLOSURE

Aspects of this invention relate to wear members for wear assemblies for ground-engaging equipment. Aspects of this invention also include a wear member and lock combined as a single integral component, i.e., the wear member includes a wearable body and a lock joined together. Aspects of this invention also relate to the locks, wear members (e.g., points, adapters, shrouds, etc.) and the bases individually.

The locks in accordance with at least some examples of this invention will have two engagement positions with respect to the wear member: A first engagement position, or shipping position, that secures the lock to the wear member, and a second engagement position, or installed position, that can secure the wear member to a base. A wear member with certain embodiments of the lock held in the shipping position ships "ready to install." Such a wear member may be installed onto a base with the lock still in the shipping position. No movement of the lock from the shipping position is required to initiate the install procedure. Furthermore, the lock need not be removed from the wear member to install the wear member onto a base or to remove the wear member from a base.

Locks according to examples of this invention further are configured to be unlatched and removed from the wear member in two phases, including a first phase with retraction of the latching mechanism (e.g., at least partially into the body of the lock), followed by a second phase with rotation of the lock itself away from the wear member to allow removal of a wear member from a base.

Wear members for ground-engaging equipment (e.g., excavating equipment) according to some examples of this invention include a mounting portion for engaging a base of the equipment (for mounting the wear member to the equipment), the mounting portion having a first leg and a second leg opposite the first leg spaced apart to receive the base. The first leg of this example structure includes a first rail and a second rail extending rearward toward a rear edge of the first leg, the first and second rails each having an outer side surface to bear against complementary surfaces on the base. The first and second rails may axially converge in a direction toward the rear edge. Such wear members further may include a hole for receiving a lock through one of their legs (e.g., between the rails), a lock access recess that extends from the hole to one of the sides of the leg, and optionally, a lock engaged at the hole. Optionally, the lock access recess may extend over one of the rails.

Wear members (e.g., shrouds, points, adapters, runners, etc.) in accordance with some aspects of this invention include a mounting portion for engaging a base of the equipment for mounting the wear member to the equipment. The mounting portion of this example structure has an interior surface facing the base and an exterior surface, and the mounting end defines a lock receiving area including a hole extending through the mounting end from the exterior surface to the interior surface. This hole has a rear wall with a support projecting inwardly into the hole for a lock to engage and swing inward to engage the base and hold the wear member to the equipment and swing outward to release the base and permit release of the wear member from the equipment. The support may be located adjacent the interior surface of the wear member and spaced from its exterior surface, and the support may extend partially or completely along the rear wall of the hole (the support also may extend along the rear wall of the hole for a greater distance than it extends into the hole or away from the rear wall). The front wall of the hole (located opposite the rear wall) of this example structure has an outer portion extending from the exterior surface and an inner portion forming a pocket (e.g., an undercut) recessed forwardly into the wear member with respect to the outer portion and extending to the interior surface for receiving a latch portion of the lock to retain the lock in the inwardly swung position. Such wear members further may include a lock engaged with the wear member, and optionally, this combination wear member and lock may be mounted to an equipment base to provide a wear assembly.

Wear members in accordance with at least some examples of this invention will include a lock access recess in their exterior surface that extends away from the lock mounting hole generally in a direction between front and rear walls of the hole (e.g., sideways from the hole). For some wear members, the hole and lock access recess may be provided in a side wall of the wear member, and for other wear members, the hole and lock access recess may be provided in a top wall or leg of the wear member.

Wear members according to still additional aspects of this invention may include a mounting portion for engaging a base of the equipment (for mounting the wear member to the equipment), the mounting portion having an internal surface facing the base and an opposite external surface, a hole extending through the mounting portion from the external surface to the internal surface, and a lock integrally mounted in the hole for movement between a locked position where the lock is positioned to contact the base to hold the wear member to the equipment and a release position where the lock is positioned to release the base. This example lock has a lock body, a rotating actuating member, and a latch member movable between a first position to engage the wear member to hold the lock alternatively in the locked and release positions, and a second position retracted from the first position. If desired, in at least some example structures according to this invention, the latch member may engage the wear member even in the second (retracted) position, particularly when the parts are relatively new and/or unworn. e.g., so that the lock does not come out of the wear member. Optionally, such locks further may include a resilient member or other structure to bias the latch member to the first position.

Additional aspects of this invention relate to locks for securing a wear member to equipment (e.g., for securing wear members of the types described above). Such locks may include: a lock body including a front bearing surface for contacting a base on the equipment and a rearwardly-opening recess for receiving a complementary support in a hole of the wear member; an actuator member movably coupled to the lock body; a latch member movably coupled with the actuator member and the lock body such that movement of the actuator member relative to the lock body moves the latch member between a latched position in which a portion of the latch member extends outward (e.g., from a side of the lock body) in a direction to contact the wear member and an unlatched position in which the latch member is retracted relative to the latched position; and, optionally, a biasing member for biasing the latch member toward the latched position.

Locks according to still other aspects of this invention may include: a lock body having a bearing surface on one end for contacting the base to hold the wear member to the equipment, and a recess at an opposite end to receive a support on the wear member about which the lock body will turn between a locked position where the bearing surface will contact the base and a release position where the bearing surface will release the base; a latch member movably coupled to the lock body to move between a first position where the latch member contacts the wear member and a second position where the latch member is retracted relative to the first position to disengage the wear member; an actuating member rotatably coupled to the lock body and movably coupled to the latch member such that initial rotation of the actuating member moves the latch member relative to the lock body and further rotation of the actuating member moves the lock body about the support on the wear member; and optionally, a biasing member, such as a resilient member, to bias the latch member to the first position.

In locks of the various types described above, the actuator member may rotate in the lock body on a first axis, and the latch member may be pivotable about a second axis between the latched and unlatched positions. These two axes may be parallel and non-aligned in some embodiments, and they may be non-parallel in other embodiments. When non-parallel, the first axis may diverge from the second axis at an angle from 0° to 45° as measured in a plane to which both axes are projected (and in some examples, at an angle from 5° to 35°). The actuator member may have a tool interface and a cam for engaging the latch member and translating motion of the actuator member to the latch member for moving the latch member between the latched and unlatched positions.

The advantages of the locks and wear assemblies of the present disclosure will be more readily understood after considering the drawings and the Detailed Description.

DETAILED DESCRIPTION OF THE DISCLOSURE

The present invention pertains to a wear assembly for ground-engaging equipment. This application includes examples of the invention in the form of an excavating tooth and a shroud. Nevertheless, the invention is not limited to these examples. For instance, aspects of the invention can be used in regard to other kinds of wear parts such as intermediate adapters and runners. Although the application describes wear assemblies in connection with excavating buckets, aspects of the invention can be used for attaching wear members to other ground-engaging equipment such as dredge cutter heads, chutes, truck bodies, etc. The terms "top" and "bottom" are generally considered interchangeable since the teeth can typically assume various orientations when attached to earthmoving equipment. The "front" and "rear" of the wear parts are considered in the context of the primary direction of movement of earthen material relative to the wear part. For example, in regard to a point of a tooth system, the front is the narrowed edge of the point because the primary motion of the earthen material relative to the point is from this narrowed edge "rearward" toward the base-receiving cavity in an ordinary digging operation.

Figure 1:
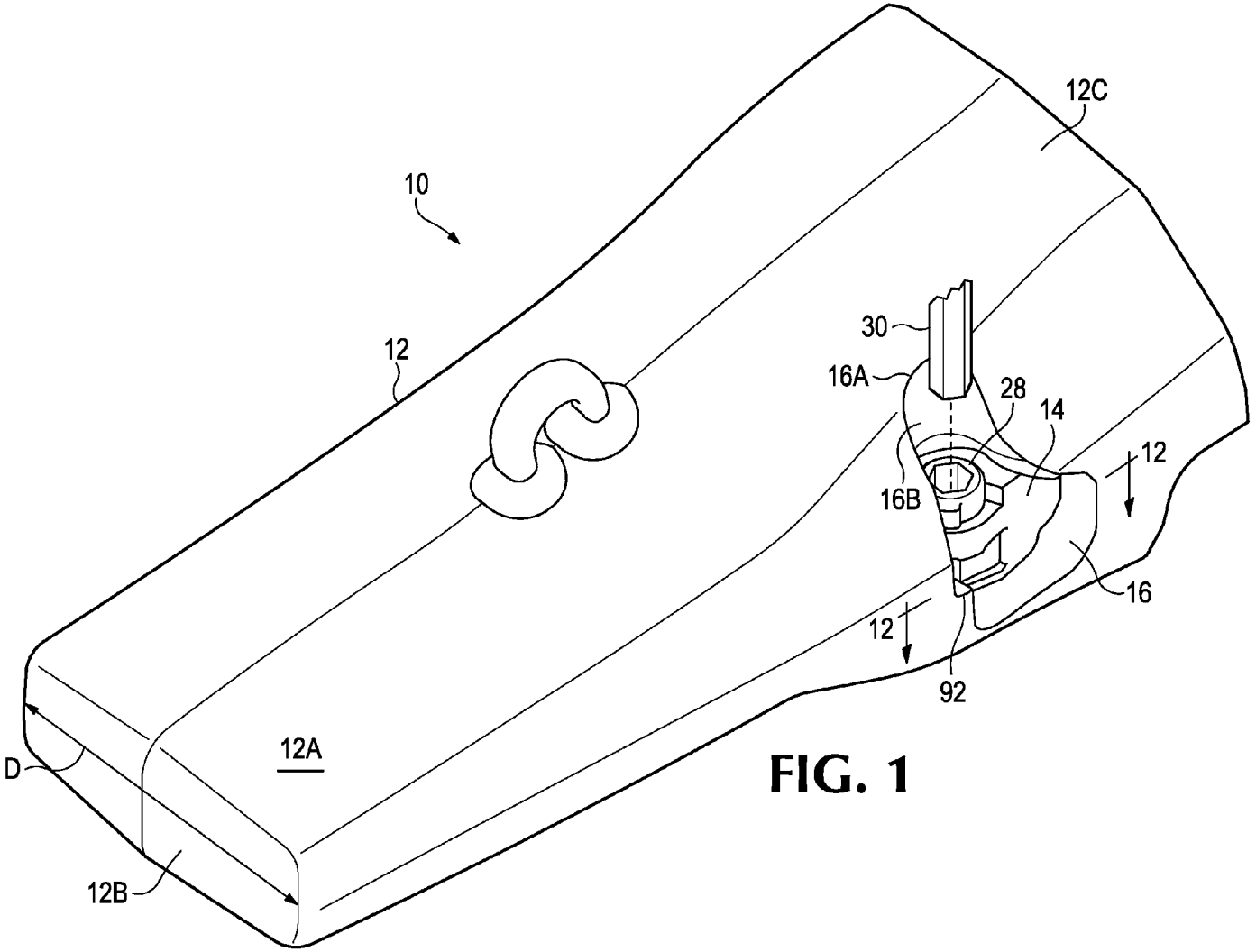
FIG. 1 is a perspective view of a wear assembly including a wear member and a lock according to an embodiment of the present invention.

An example wear assembly 10 according to an embodiment of the present invention is shown in FIG. 1. The wear assembly 10 includes a wear member 12 and a lock 14 associated with wear member 12. As will be discussed in greater detail below, lock 14 may be physically coupled to wear member 12, and when so coupled may nest within a lock recess 16 having a shape that is defined by wear member 12 and that is complementary to the shape of the lock 14. This nesting of lock 14 within lock recess 16 tends to shield the lock from wear.

In one embodiment of the invention, a wear assembly 10 composed of the combined wear member 12 and lock 14 may be sold, shipped, stored, and/or installed as a single unit. In this embodiment, wear member 12 has a working portion 12A in the form of a narrowed front edge 12B to penetrate the ground during digging, and a mounting portion 12C with a rearwardly-opening cavity for receiving a base. The mounting portion 12C has a lock receiving area 16 structured to receive and cooperate with a lock that is adapted to releasably secure the wear member to the base.

A latching mechanism holds lock 14 in place within wear member 12 and preferably prevents the lock 14 from disengaging from the wear member 12 and/or from being lost or misplaced during shipment, storage and installation of wear member 12. In another embodiment of the invention, the use of a single integral wear member and lock also reduces the number of parts to be held in an inventory. The latching mechanism holds lock 14 in place within wear member 12, permitting shipment and storage of wear member 12, and to additionally permit the wear member 12 to be installed upon an appropriate base, preferably without first moving or removing the lock 14. For example, in some embodiments, lock 14 is preferably held to wear member 12 in a first position so that lock 14 does not obstruct installation of wear member 12 onto a base. In other embodiments, or in certain situations where lock 14 has moved during shipment within a lock recess 16, the latching mechanism allows lock 14 to move relative to wear member 12, without falling out of wear member 12. In these embodiments and situations, lock 14 preferably moves easily relative to wear member 12, during installation onto a base.

When wear member 12 with lock 14 in place is put into service, lock 14 is readily fully installed by a further rotation of a portion of lock 14, as discussed in detail below, to fully install and retain lock 14 and the corresponding wear member 12 in place on excavating equipment, not shown.

Figure 2:
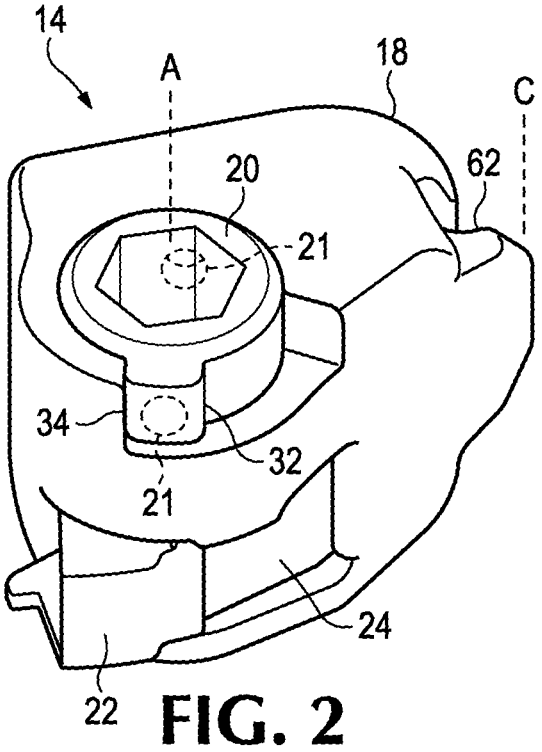
FIG. 2 is a perspective view of the lock of FIG. 1.
Figure 3A:
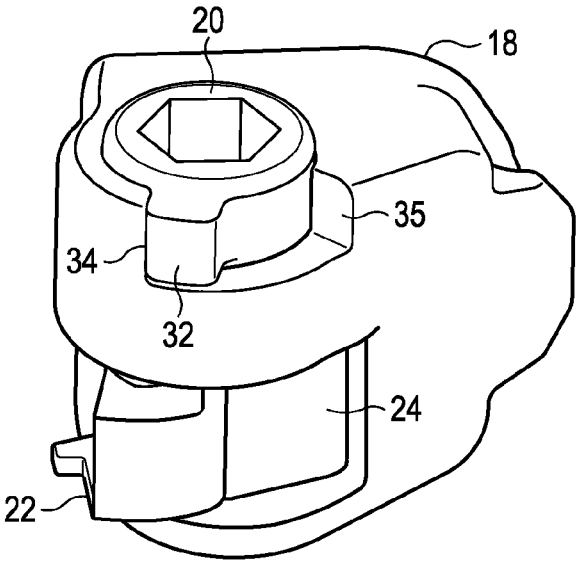
FIGS. 3A-3C show the lock of FIG. 1 in perspective, plan, and side elevation views, respectively.
Figure 3B:
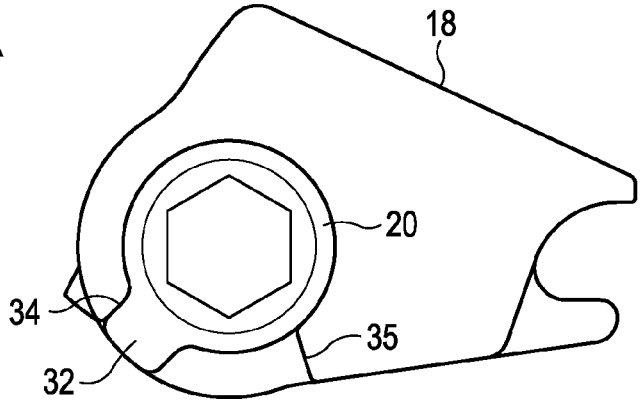
Figure 3C:
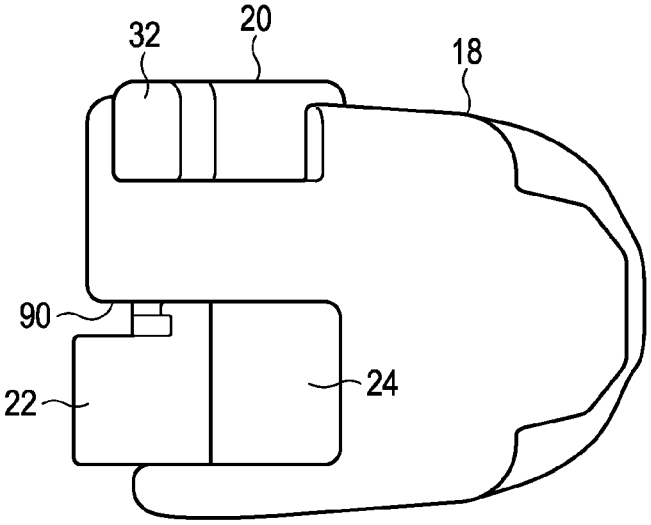
Figure 4:
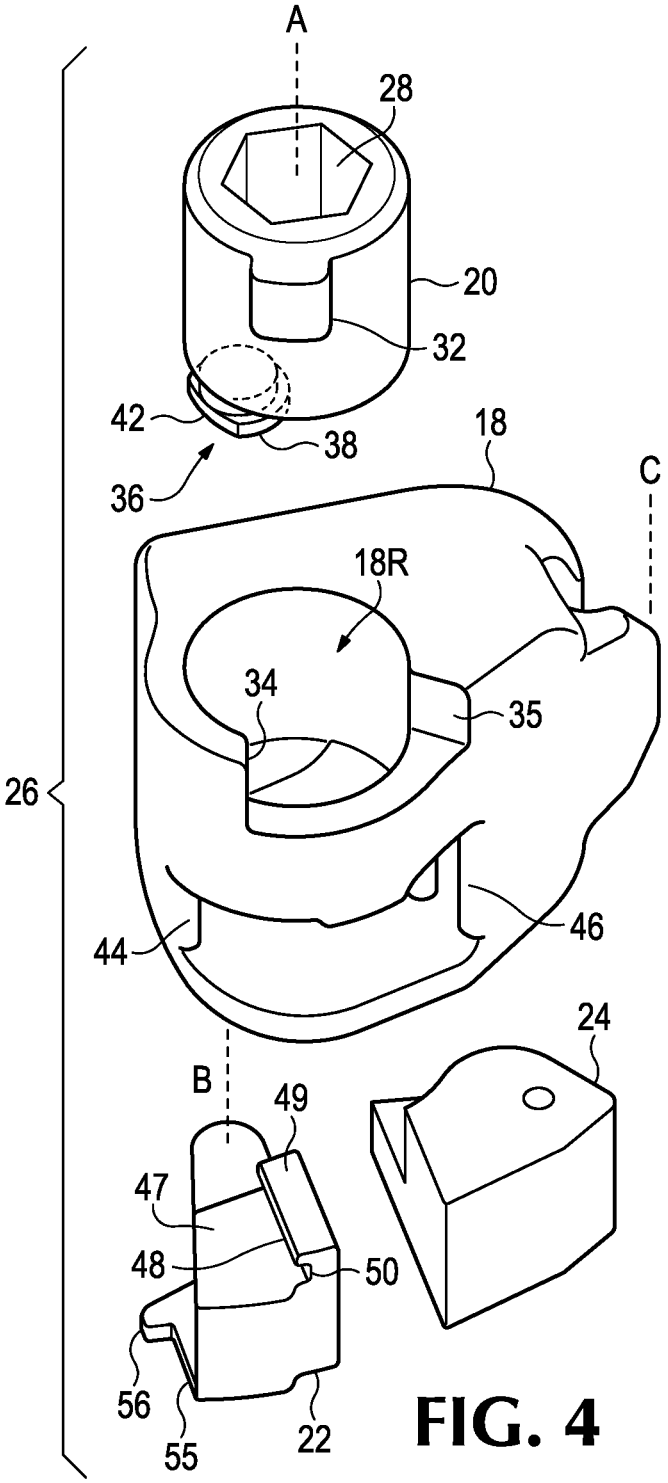
FIG. 4 is an exploded view of the lock of FIG. 1.

An example lock 14 is shown in FIG. 2, FIGS. 3A-3C, and also in exploded view in FIG. 4. As can be appreciated by viewing FIG. 4, lock 14 includes a lock body 18, an actuating member 20, a latch member 22, and a resilient body 24. Resilient body 24 biases latch member 22 relative to lock body 18, which tends to keep latch member 22 in a latched position.

Figure 5A:
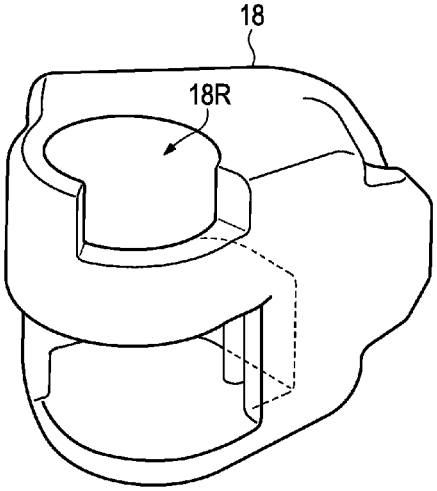
FIGS. 5A and 5B are right perspective and plan views of a lock body for the lock of FIG. 1, where the lock body is semi-transparent.
Figure 5B:
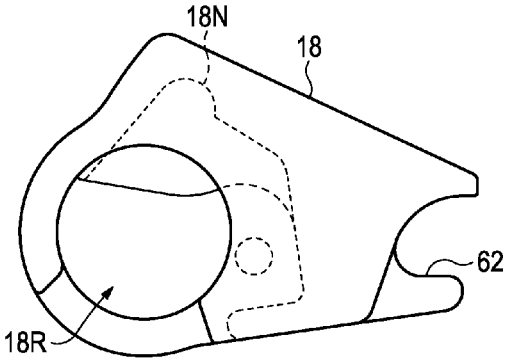
Figure 6A:
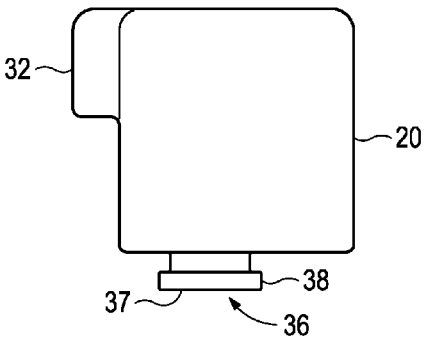
FIGS. 6A-6C are side elevation, right perspective, and top perspective views, respectively, of an actuator member for the lock of FIG. 1.
Figure 6B:
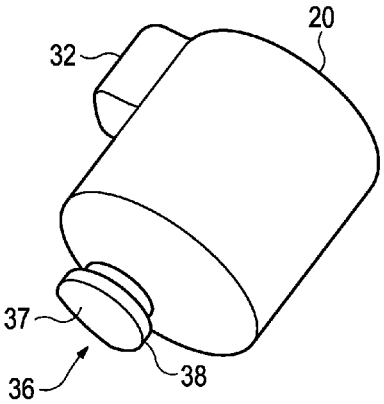
Figure 6C:
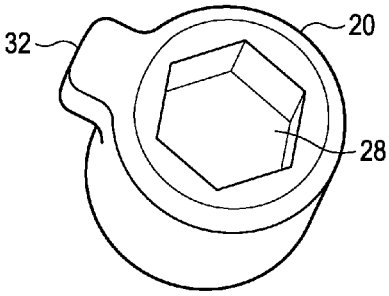

In a preferred construction, lock body 18, which is preferably of unitary construction, provides a mount and housing for the actuating member 20, latch member 22, and resilient body 24 which, when considered in combination, make up a latch mechanism 26 of the lock 14. Lock body 18 is shown in FIGS. 5A and 5B, where certain internal structures of lock body 18 are shown in broken lines.

As shown in FIG. 4 and FIGS. 6A-6C, actuating member 20 is received within a corresponding recess 18R in lock body 18. Actuating member 20 is generally cylindrical in form, and is configured to rotate in place. An upper surface of actuating member 20 may incorporate a tool interface 28 for engaging with an appropriate tool 30 so that the actuating member 20 may be rotated clockwise or counterclockwise. Typically, tool 30 includes an extended handle, that is, a handle having adequate length so that a user can apply sufficient torque to the actuating member 20 to rotate the actuating member 20.

For example, actuating member 20 is shown with a tool interface 28 in the form of a hexagonal socket. Actuating member 20 may therefore be rotated using a tool 30 incorporating a hex key, as shown in FIG. 1. However, any similarly effective interface may be used to facilitate rotating of the actuating member, such as a tool interface having a projecting hexagonal head with a tool that incorporates an open-ended or socket hex wrench, or a hole that opens in a side of the actuating member, to receive a rod or pry bar, among others. A pair of holes 21 for receiving a tool for rotating the actuating member 20 at the actuating member 20 side is shown as dashed lines in FIG. 2. Similarly, other types of tools may be used, such as an impact wrench or other types of rotary devices.

The head of the actuating member 20 preferably includes a tab 32. One visual benefit of the tab 32 is to indicate to a user whether the actuating member 20, and therefore the latch mechanism, is in the latched position, unlatched position, or some intermediate position. When in the orientation shown in FIGS. 3A-3C, tab 32 will be to the left or clockwise side of lock recess 16 when the latch mechanism is latched, and tab 32 will be to the right or counter-clockwise side of lock recess 16 when the latch mechanism is unlatched. The tab 32 also serves to limit the extent of rotation permitted to the actuating member 20, as the tab 32 prevents the actuating member 20 from being rotated beyond the point that the tab 32 contacts a left stop 34 or a right stop 35 defined by the lock body 18. When the latch mechanism is in a latched configuration, actuating member 20 is rotated clockwise (as seen from above) until tab 32 rests against (or immediately adjacent) left stop 34. In this position, latch member 22 is resting against (or immediately adjacent) left stop 44.

Applying additional torque to actuating member 20, when tab 32 has contacted either left stop 34 or right stop 35 (or through other parts of the lock), transfers this torque to lock body 18. This transferred torque may create a rotation of lock body 18 relative to wear member 12. For example, clockwise movement of a tool 30 will rotate actuating member 20 clockwise, and then pivot lock body 18 clockwise to move the lock 14 into an installed position. Counterclockwise movement of a tool 30 will rotate actuating member 20 counterclockwise, and then pivot lock body 18 counterclockwise so that the lock 14 is removed in two phases. As described in more detail below, these two phases include: (1) rotation of actuating member 20 about an actuating axis of rotation (axis A) to cause a first retraction of the latching mechanism as the latching mechanism rotates about a latching axis of rotation (axis B), followed by (2) a rotation of lock 14 itself generally about a locking axis of rotation (axis C)—though the movement of lock body 18 is preferably not strictly a pivotal movement.

It is believed that unlatching the lock in two phases is particularly helpful when the latching mechanism has been contaminated with grit and fines (e.g., dirt and other debris that gets into the lock 14 and lock recess 16 during use of the equipment). In particular, a substantial portion (i.e., the initial portion) of the rotation in a counter-clockwise rotation results only in retraction of the latching mechanism, so substantial leverage is created over a very small movement of the latching mechanism. It is believed that this tends to free or breakup fines that might have been compacted and solidified within the latching mechanism during use in extreme conditions. Once the first phase of rotation is completed, with initial break up or loosening of any fines, further rotation results in movement of the entire lock.

The underside of actuating member 20 includes a cam 36, projecting downward from the underside of the actuating member, and offset from an actuating axis of rotation A of actuating member 20 (see FIGS. 2 and 4). The camming action of cam 36 is provided by the offset of cam 36 relative to axis of rotation A of actuating member 20. The offset cam 36 may be helpful in clearing any accumulated grit or fines from the latch mechanism as actuating member 20 is rotated. Other embodiments, not shown, may include a cam recessed into or projecting from other surfaces of the actuating member.

The cam 36 preferably includes a planar lower face 37. The cam 36 may additionally include a flange 38 that projects horizontally from the lower edge of cam 36. Although the shape and surface formation of the cam may vary, cam 36 is preferably (largely) circular in cross-section, as is the flange 38. Where the offset of cam 36 would otherwise result in the flange 38 projecting beyond the circumference of the cylinder of actuating member 20, that portion of flange 38 is truncated to substantially align with and match the curvature of the actuating member 20, resulting in cam edge surface 42. The cam 36 also may be somewhat D-shaped or hemi-cylindrical shaped (e.g., with a flattened edge) in some constructions.

As tab 32 of actuating member 20 is moved between the limits defined by left stop 34 and right stop 35, cam 36 of the actuating member acts upon latch member 22 to pivot the latch member about latching axis of rotation B between a latched configuration and an unlatched configuration.

In the latched configuration, shown in FIG. 2, with tab 32 against stop 34, latch member 22 is urged by resilient body 24 against a left latch stop wall 44 in lock body 18, shown best in FIG. 4. The latch 22 may be stopped by engagement with cam 36 rather than by stop wall 44. A right latch stop wall 46 is also shown in FIG. 4, but this does not need to function as a stop as movement may be caused by contact of tab 32 against stop 35 or full compression of the resilient body 24. By rotating actuating member 20 counterclockwise, cam 36 urges latch member 22 against resilient body 24, and thereby pivots latch member 22 around latching axis B, which is offset from actuating axis of rotation A. Continued rotation of actuating member 20 will continue to pivot latch member 22 around latching axis B, with an accompanying compression of resilient body 24, until tab 32 of actuating member 20 contacts stop 35 (see FIG. 4).

In a preferred construction, latch 22 tapers to a narrowed, rounded end 22A (FIGS. 7A-7C) that fits within a complementary notch 18N (FIG. 5B) to form a fulcrum or pivotal mount. Latch member 22 may optionally include a vertically-oriented through-hole through which may pass a pin that serves to anchor latch member 22 to lock body 18. Where such a pin is present, the pin is preferably coincident with latching axis of rotation B and serves as a pivot point for latch member 22. Other structures also may be used to assure and facilitate rotation of latch member 22 about latching axis of rotation B.

Figure 7A:
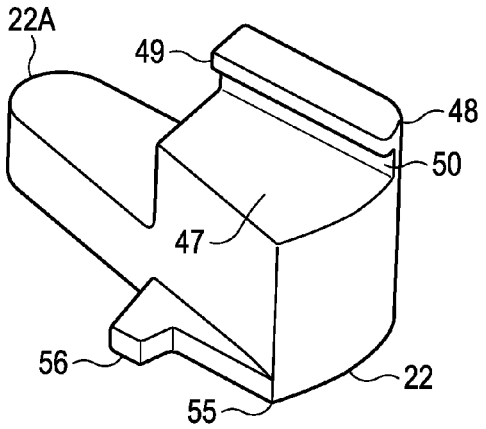
FIGS. 7A-7C are left perspective, right perspective, and plan views, respectively, of a latch member for the lock of FIG. 1.
Figure 7B:
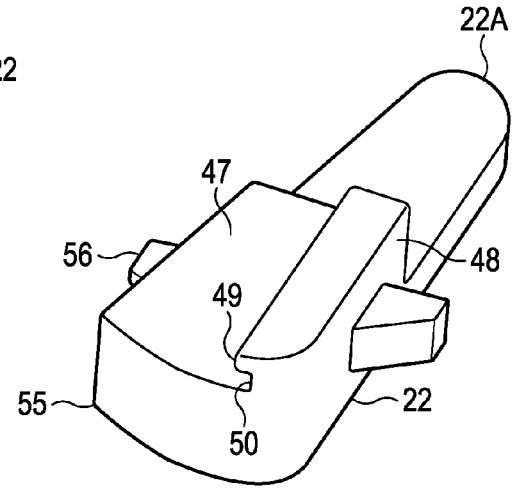
Figure 7C:
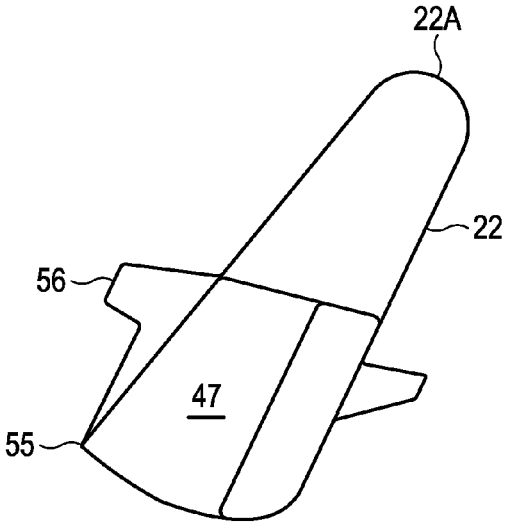

As shown in FIGS. 7A-7C, latch member 22 includes a planar surface 47 that faces the lower cam face 37 of cam 36. Planar surface 47 is bounded on one side by a side wall 48 (optionally a vertical wall), where the side wall 48 is configured to be pushed by cam 36. The lock 14 may incorporate one or more features to assist in retaining the actuating member 20. Actuating member 20 should be rotatable, but actuating member 20 should not be removable, separate from lock 14. For example, cam 36 may include a flange 38, and side wall 48 may include an upper shelf 49 that defines a horizontal channel 50 along side wall 48. Horizontal channel 50 may be configured to mate with flange 38 of cam 36 so that the actuating member 20 is retained in the lock 14 and is prevented from moving in the vertical direction (i.e., on account of the bias of resilient body 24). Other retention methods for the various elements may be used, but are not shown, such as a roll pin or spring pin forced through one or more holes in latch member 22 that might interface with a portion of lock body 18 or a roll pin going through the lock body 18 that might interface with a groove in actuating member 20.

Figure 8A:
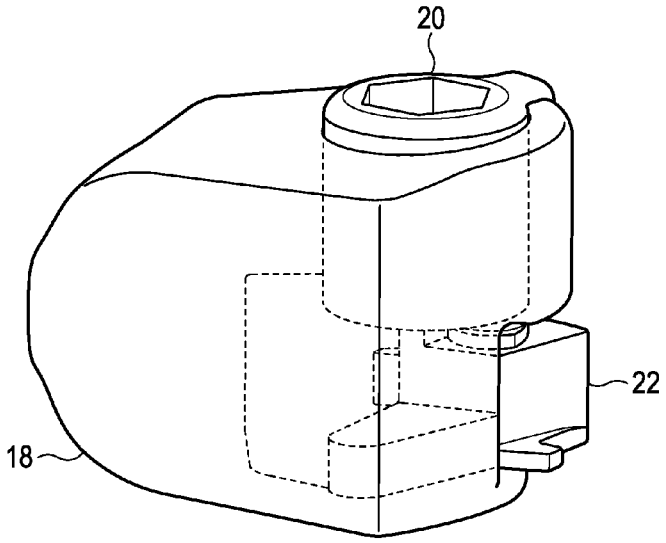
FIGS. 8A and 8B are left and right perspective views of the lock of FIG. 1, respectively, where selected lock components are semi-transparent.
Figure 8B:
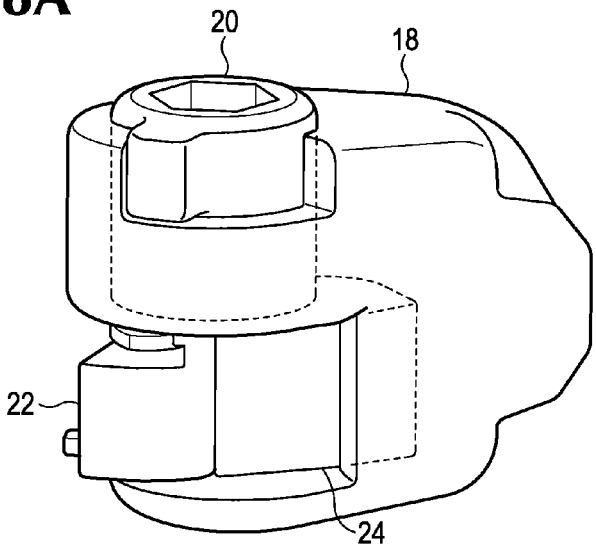

FIGS. 8A and 8B show actuating member 20, latch member 22, and resilient body 24 assembled within lock body 18. Referring collectively to FIGS. 6B, 7A, 8A, and 8B, the lower face 37 of cam 36 is adjacent planar surface 47, and flange 38 of cam 36 engages horizontal channel 50, if present.

Figure 9:
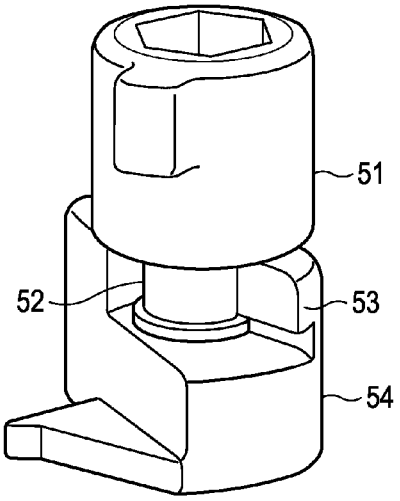
FIG. 9 is a perspective view of an alternative embodiment of a combined actuator member and latch member according to the invention.

In an alternative embodiment, depicted in FIG. 9, an actuating member 51 may include cam 52 that shares an axis of rotation of the actuating member 51, where the cam 52 has a substantially hemi-cylindrical cross-section. The latch mechanism is configured so that the resulting flat vertical cam face 52*f* of cam 52 (see FIG. 11A) contacts a vertical wall 53 of a latch member 54. As in the previous embodiment, rotation of the actuating member 51 results in cam 52 urging latch member 54 against a resilient body (e.g., body 24).

Returning attention to FIGS. 7A-7C, latch member 22 includes an engagement surface 55 and a latch tooth 56, with latch member 22 configured so that when latch member 22 contacts or is adjacent to left latch stopwall 44, both engagement surface 55 and latch tooth 56 extends outward (e.g., from a side of the lock body 18) in a direction to contact a wear member, as shown in FIGS. 2 and 3A. However, by rotating actuating member 20 approximately 75-degrees in a counter-clockwise direction about actuating axis of rotation A (using an appropriate tool 30), the eccentric rotation of offset earn 36 results in cam 36 urging latch member 22 inward against resilient body 24, thereby compressing resilient body 24 and simultaneously retracting engagement surface 55 and latch tooth 56 inward toward lock body 18 (at least retracted sufficiently from its outward extension to permit the desired operations).

Resilient body 24 is typically sufficiently yielding to permit latch member 22 to be depressed against the resilient body when actuating member 20 is rotated into the unlatched configuration. However, resilient body 24 may be selected to have greater or lesser degrees of resilience, such that even when actuating member 20 remains in the latched configuration, urging the lock body 18 into position in lock recess 16 results in latch member 22 becoming depressed against the resilient body 24. In this way, lock body 18 may be urged into position in lock recess 16 of wear member 12 while the lock 14 remains latched, for example by pivoting the lock 14 into position with tool 30.

Figure 10:
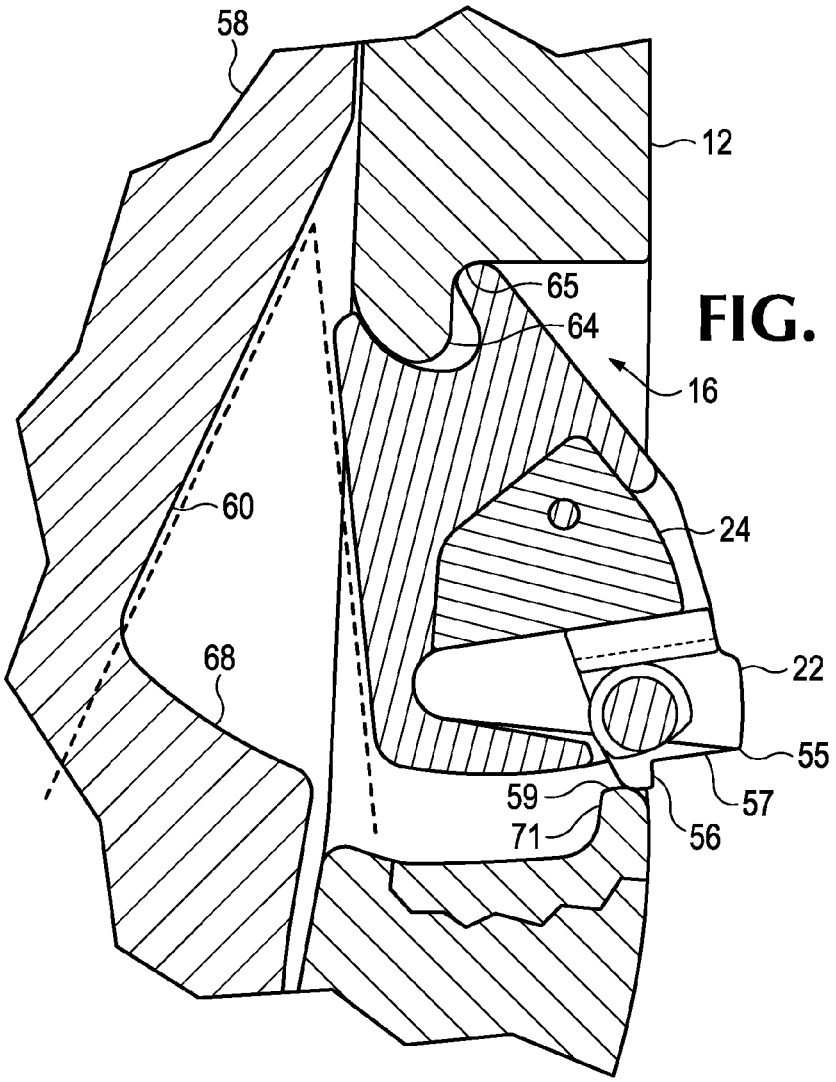
FIG. 10 is a cross-sectional view of the lock and wear member of FIG. 1, in combination with a base, but showing the lock at initial insertion of the lock into the wear member.
Figure 11:
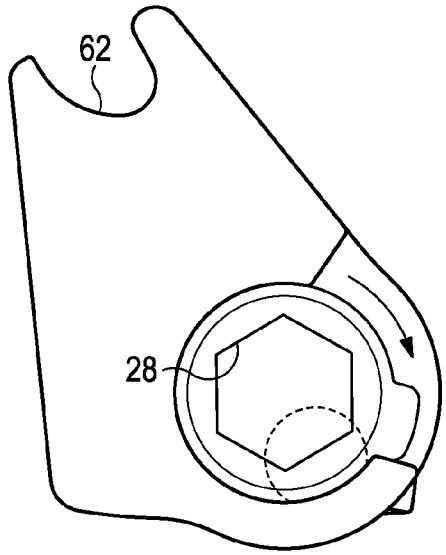
FIG. 11 is a top plan view of the lock of FIG. 10, either after removal from the wear member, or prior to insertion of the lock into the wear member while in a latched configuration.
Figure 12:
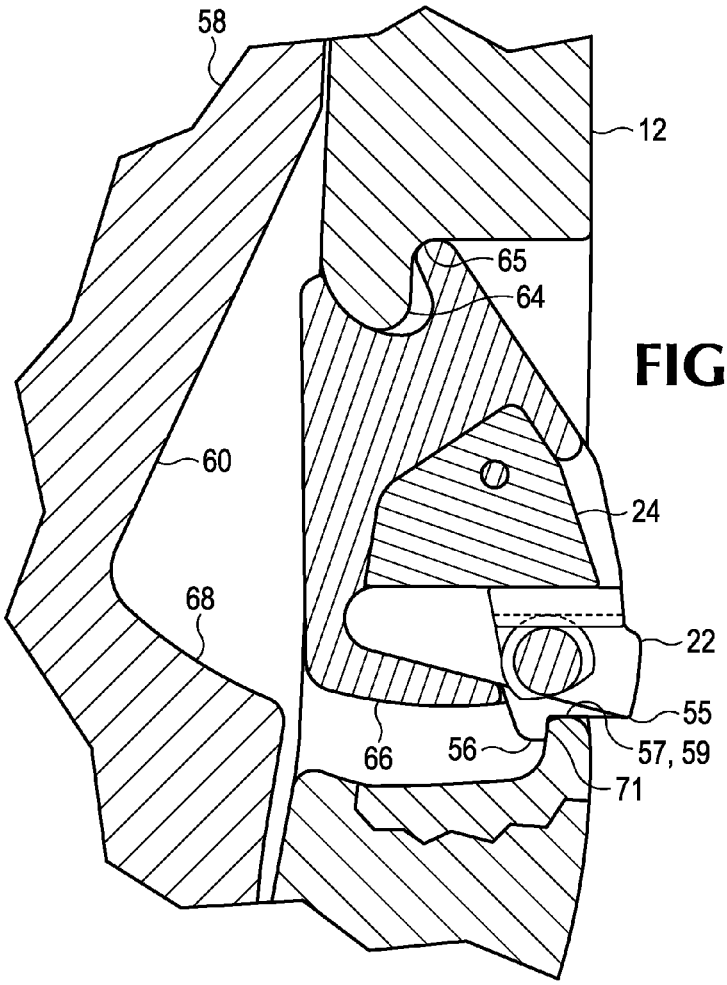
FIG. 12 is a partial cross-sectional view of the lock and wear member of FIG. 10, in combination with a base, the lock being in a shipping position, with the cross-sectional view taken along the plane indicated by line 12-12 in FIG. 1.

For example, when a new wear member 12 is ready for shipment, a new lock 14 may be placed into lock recess 16, as shown in FIG. 10. A tool 30 of the type shown in FIG. 1 is then placed into tool interface 28, and rotated clockwise as indicated in FIG. 11 by an arcuate arrow. This forces lock 14 into a first or release position, as shown in FIG. 12. The latch 22 retracts against resilient body 24 when lock 14 is moved from the uninstalled condition to (and through the installing position shown in FIG. 10) to the first or initial installed position. Lock 14 will be then retained securely within wear member 12 in this position for shipping and/or storage. More specifically, resilient body 24 exerts sufficient force on latch member 22 such that when the lock 14 is in the first position, it becomes difficult to move lock 14 relative to wear member 12; i.e., latch 22 is pressed against corner surface 65 of support 64 to resist inward movement of lock 14, and tooth 56 presses against the recess curve 71 to resist outward movement of lock 14. The lock 14 is not typically moved without the use of an appropriate tool or other significant external force.

Furthermore, the presence of lock 14 in the first position does not interfere with installing the wear member 12 onto an appropriate base. Note that such a base 58 is shown in FIG. 10. However, the base 58 is not needed in order to put or hold lock 14 in the first position, and is shown in FIG. 10 for reference in other portions of this description.

Figure 14:
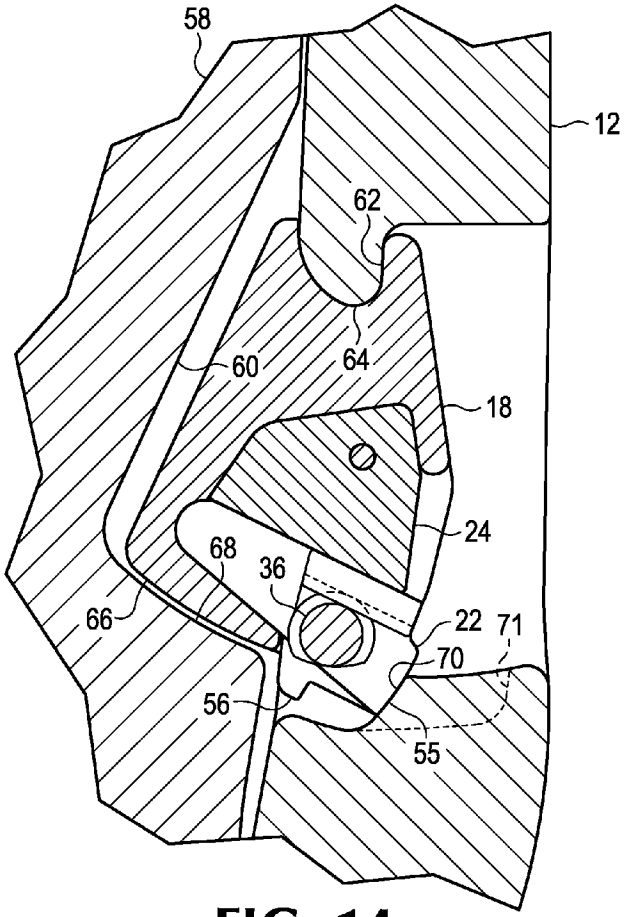
FIG. 14 is a cross-section view of the lock and wear member of FIG. 13.
Figure 13:
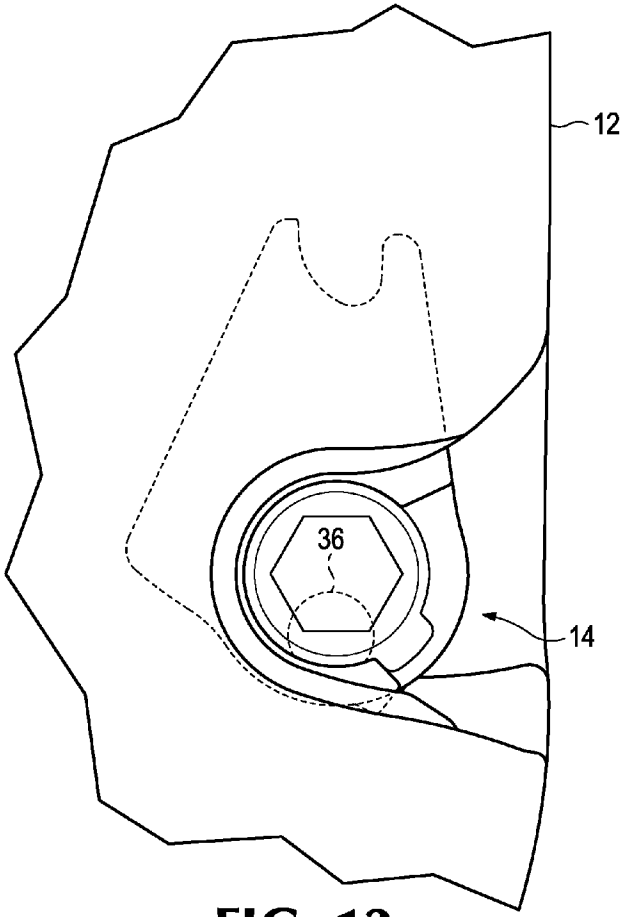
FIG. 13 is a partial plan view of the lock and wear member of FIGS. 10 and 12, in an installed configuration, to fully retain the lock and the corresponding wear member, in place on the base.

Lock 14 is configured to secure a wear member 12 to a base 58 when the lock 14 is pivoted from the first or release position of FIG. 12 to the second or locked position, as shown in FIGS. 13 and 14. Base 58 may be an integral portion of a piece of excavating equipment (or other ground-engaging equipment), or base 58 may be attached to such equipment (e.g., an adapter), such as by welding or other mechanical attachment. A suitable base 58 is shaped generally to accept the wear member 12 securely, and includes an opening or notch 60 that is sized and adapted to receive at least a portion of lock body 18 when the lock is moved to the second or locked position (e.g., when the lock body is fully inserted into lock recess 16).

Lock 14 preferably includes a coupling structure or anchor feature 62 that is configured to cooperate with a complementary support feature 64 formed in the proximal wall of lock recess 16. Anchor 62 and support 64 are configured so that lock 14 can be seated by the interaction of anchor 62 with complementary support 64, and lock 14 then may be swung into lock recess 16 generally around locking axis of rotation C (shown in FIG. 2) in order to move the lock body 18 into base notch 60, as shown best in FIG. 14. The anchor 62 and support 64 preferably are configured to facilitate a rotation of the lock 14 around axis C. For example, in one embodiment of the invention as shown, anchor 62 corresponds to a slot that interacts with a support 64 corresponding to a vertical ridge formed in the proximal wall of the lock recess 16 (see FIGS. 10 and 12). Although not preferred, the slot could be formed on the wear member and the ridge on the lock.

When properly positioned, a front or distal face 66 of lock body 18 opposes a complementary resisting surface 68 of opening 60, and a force that would otherwise urge the wear member 12 outward and remove it from the base 58 results in contact between distal face 66 and resisting surface 68, effectively locking wear member 12 in place on base 58. At the same time, lock body 18 is retained in lock recess 16 by contact between engagement surface 55 and shoulder 70 of lock recess 16, as shown in FIG. 14. The geometry of lock 14 and lock recess 16, and more specifically of lock body 18 and latch member 22 relative to support 64 and shoulder 70, is such that lock 14 tends to be self-binding. The only way for lock 14 to move past both support 64 and shoulder 70 is for latch member 22 to be counter rotated, so that lock 14 may pivot out of recess 16. Any pivoting of lock 14 prior to counter rotation of latch member 22 tends to pull latch member 22 farther away from the unlatched position, rather than pushing latch member 22 toward an unlatched position. This makes lock 14 a particularly reliable lock, even when subjected to extreme stresses under loading.

In a particular embodiment of the invention, the geometries of the lock 14, and the wear member 12 are selected so that if force is applied upon lock 14 that would otherwise urge the lock out of the wear member 12 (e.g., movement of the wear member 12 under load, presence of fines, etc.), the conformation of support 64 will urge the lock 14 forward within the lock recess, in turn, enhancing the engagement between engagement surface 55 and shoulder 70. That is, the presence of support 64 functions to contain the lock 14 in the installed position. Any forward movement of lock 14 (i.e., with slot 62 pulling from support 64) is resisted by distal face 66 abutting resisting surface 68. Any outward movement of lock 14 is resisted by latch member 22, which is in an over-center position so as to resist disengagement (see FIG. 16). Slot 62 and support 64 further cooperate to resist twisting of lock 14. In the shipping position, lock 14 is also constrained against outward movement by ridge 64 being received in slot 62, latch tooth 56 being against recess curve 71, and front wall 57 of latch member 22 being pressed against front wall 59 of lock recess 16. Twisting of lock 14 in this position is resisted by ridge 64 in slot 62, and the close proximity of the marginal walls of lock recess 16 and lock 14. In both positions, the cooperative structures create a situation where the lock 14 is constrained at both the proximal and distal ends by the wear member 12 via feature 64 and shoulder 70, and any movement of the lock 14 that would decrease interaction with one of feature 64 and shoulder 70 necessarily enhances the interaction with the other.

Figure 16:
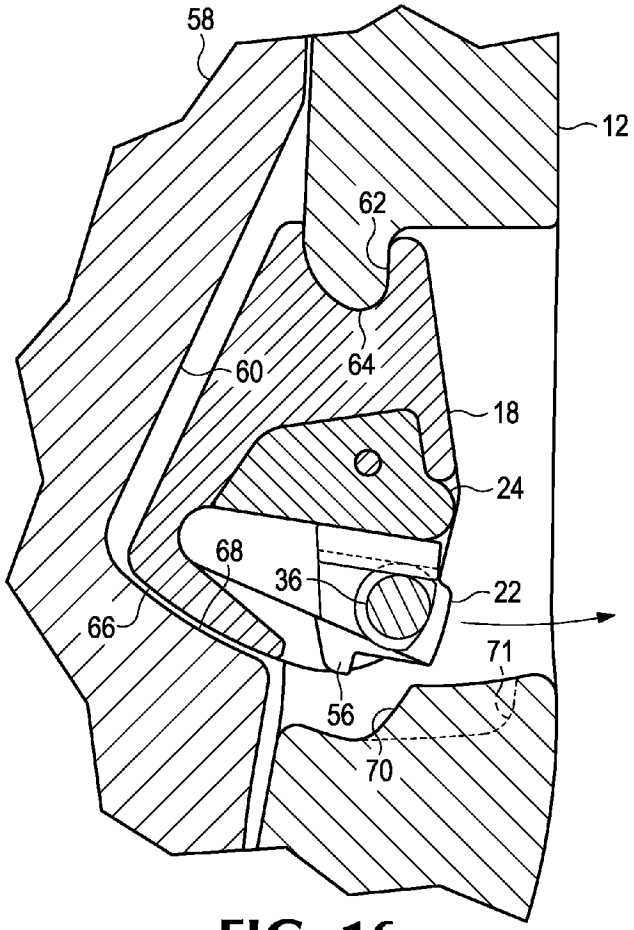
FIG. 16 is a cross-section view of the lock and wear member of FIG. 15 along a slightly higher plane from that shown in FIG. 12.
Figure 15:
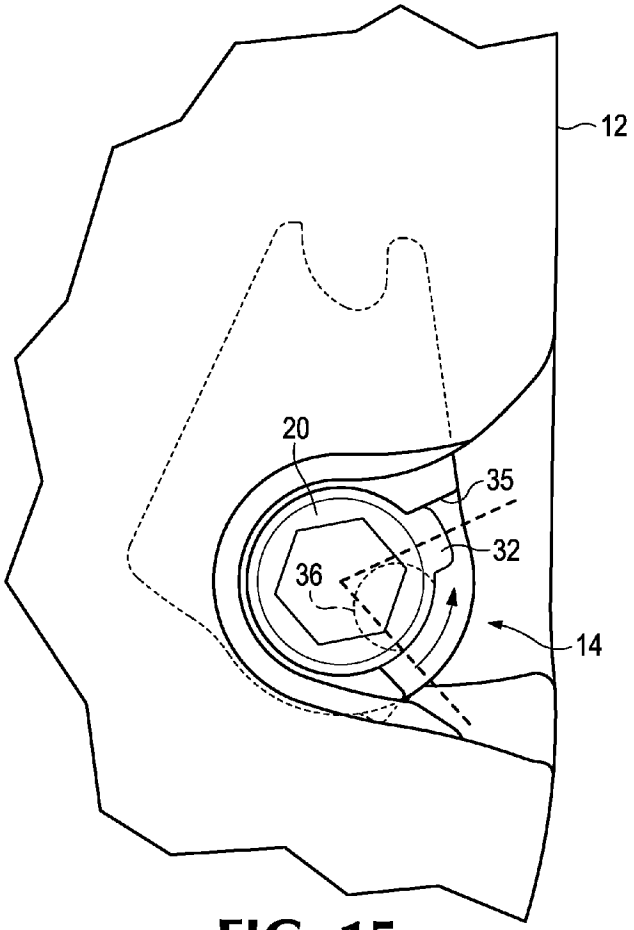
FIG. 15 is a partial plan view of the lock and wear member of FIG. 11 in an unlatched configuration, with retraction of a latching mechanism, but with the lock in a position that retains the wear member on the base.
Figure 17:
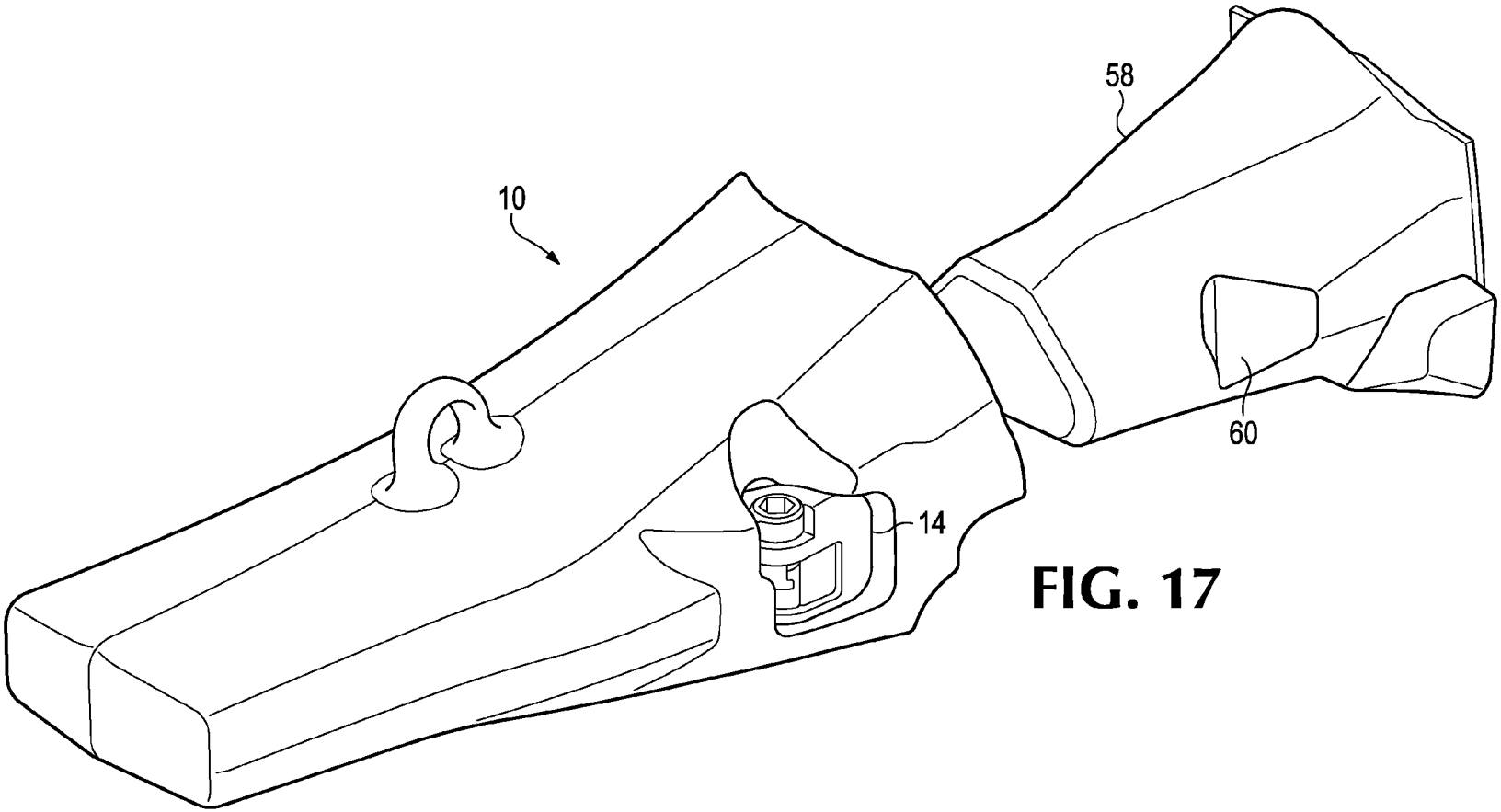
FIG. 17 is a perspective view of the wear assembly of FIG. 1 adjacent to a base according to an embodiment of the present invention.

Although lock 14 securely retains wear member 12 in position, even after extensive use, the lock 14 may be readily removed, despite the presence of sand, grit, or other fines within the latch mechanism or packed around the lock to facilitate removal and replacement of wear member 12. Removal of lock 14 is accomplished by first moving tool 30 counter-clockwise through approximately 75-degrees, as shown in dashed lines in FIG. 15. During this first phase of motion, actuating member 20 is rotated until tab 32 contacts right stop 35. Such rotation causes cam 36 to force latch member 22 against resilient body 24 and simultaneously retract engagement surface 55 and latch tooth 56 inward toward lock body 18, as shown in FIG. 16, converting lock 14 from a latched configuration to an unlatched configuration.

Although engagement surface 55 and latch tooth 56 are no longer securing lock 14 within lock recess 16, the lock 14 may still resist removal due to the presence of grit or other fines that may have accumulated in and around the lock 14. However, by applying additional force to tool 30, the entire lock 14 may be pivoted back to the first or release position within lock recess 16, as discussed above with respect to FIG. 12, by pivoting the lock body 18 counter-clockwise about an approximate locking axis of rotation C, generally defined by interaction of anchor feature 62 with support 64 (see FIGS. 2 and 4 for the approximate location of axis C). This second phase of motion results in movement of tool 30 approximately 30-degrees more, as shown in dashed lines in FIG. 10, for a total rotation of tool 30, through the two phases, of approximately 105-degrees, along with a translation of tool 30. The lock 14 alternatively could be rotated farther and simply removed from wear member 12, if desired (at least for wear members with significant wear). Further, depending on the strength of the resilient body 24, movement of the lock body 18 may occur before tab 32 contacts stop 35.

Returning attention to FIG. 4, it will be noted that locking axis of rotation C is substantially displaced from both the actuating axis of rotation A and the latching axis of rotation B. Additionally, the precise position of locking axis of rotation C may differ during installation of the lock versus removal of the lock, depending on the particular configuration of the anchor feature 62, the support 64, or both. The axis of rotation C may further move dynamically during the install and/or removal operations. In the illustrated example, lock 14 is initially placed at an angle against wear member 12 with anchor 62 placed partially onto support 64. As the front of lock 14 is swung toward wear member 12, the inner wall defining the slot of anchor 62 tends to slide along the inwardly-facing surface of support 64. When lock 14 is removed, the outer wall defining the slot of anchor 62, is forced into corner 65 of lock recess 16 to act as a fulcrum for the outward swinging of lock 14. The use of a different axis of rotation for installation and removal facilitates removal of the lock when impacted fines are present.

Figure 11A:
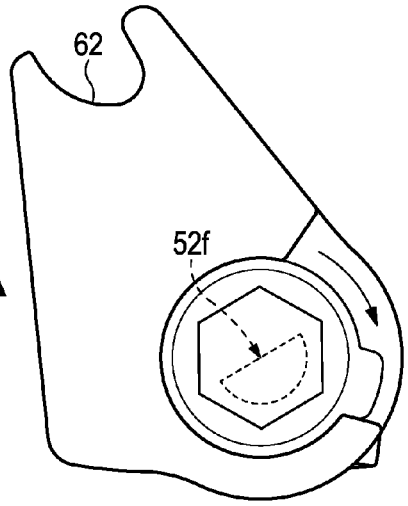
FIG. 11A is a plan view showing a lock according to the alternative embodiment of FIG. 9, with a different cam configuration from what is shown in FIG. 11, with both cam configurations of FIGS. 11 and 11A shown in dashed lines.

In an alternative embodiment depicted in FIG. 11A, an analogous lock may be employed that incorporates the actuating member 51 and latch member 54 of FIG. 9.

As discussed previously, latch member 22 may be depressed by compressing resilient body 24, even when the actuating member 20 is in the latched position. As the lock is pivoted into the first position, latch tooth 56 is depressed and slips into the lock recess while engagement surface 55 remains on the outside of lock recess 16 as shown in FIG. 12. With the lock 14 in the first position, the lock 14 is secured to the wear member 12, as the contact between latch tooth 56 and recess curb 71 prevents the lock 14 from leaving the lock recess 16. That is, the lock 14 is prevented from rotating further into the lock recess 16 by engagement surface 55 against face 59 of wear member 12, and yet it also is prevented from rotating completely out of the lock recess 16 by latch tooth 56. The first position of the lock 14 is therefore well-suited for either shipping the wear member with the integral lock, or for installation of the wear member with the integral lock.

As the resilient body 24 of the lock 14 allows movement and return of latch member 22, lock 14 may be urged into the first position while in a latched configuration by pivoting the latched lock 14 into the first position with an appropriate tool 30, or for example, by a carefully placed hammer blow or pry bar motion. Similarly, lock 14 may be urged from the first position into a second position with an appropriate tool 30, a carefully placed hammer blow, or a pry bar motion. This can be particularly beneficial when a driving tool is not readily available, as may happen in the field.

In one embodiment of the invention, wear assembly 10, which is a combined wear member 12 and lock 14, may be sold and/or shipped with the lock 14 secured to the wear member in the first or shipping position, which prevents the lock 14 from being lost or misplaced, and which is readily fully installed by a further rotation of the lock 14 to depress the latch member 22 and urge engagement surface 55 past proximal wall 70, and fully engage the lock 14 into the second or installed position. The lock 14 could be in the second position for shipping and/or storage, but it preferably is maintained in the first position so that no adjustment of the lock 14 is needed to place the wear member 12 on the base 58.

As discussed above for urging lock 14 into the first or shipping position, the lock 14 may be urged further into the installed position by an appropriate tool 30, or by other means. While lock 14 is preferably combined with wear member 12 prior to shipping, storage, and installation of the wear member 12, the lock 14 may alternatively be kept separate and only installed after the wear member 12 has been put on a base.

As mentioned above, the wear member 12 and lock 14 of the present invention may be advantageously shipped together when the lock 14 is in the first position. In addition, the design of the lock 14 is fully integrated and requires no special tools. To remove a wear member, the construction of the lock 14 allows a first rotational input to first retract the latch 22 about a latching axis of rotation B, and further rotational input transfers the moment to a different axis of rotation (e.g., axis C) and facilitates lock 14 release and/or removal. The latch tooth 56 is configured so that it will engage the proximal wall of the lock recess and retain the lock 14 in the first or shipping position, as long as the latch tooth 56 and proximal wall still exist and have not been worn away.

Figure 18:
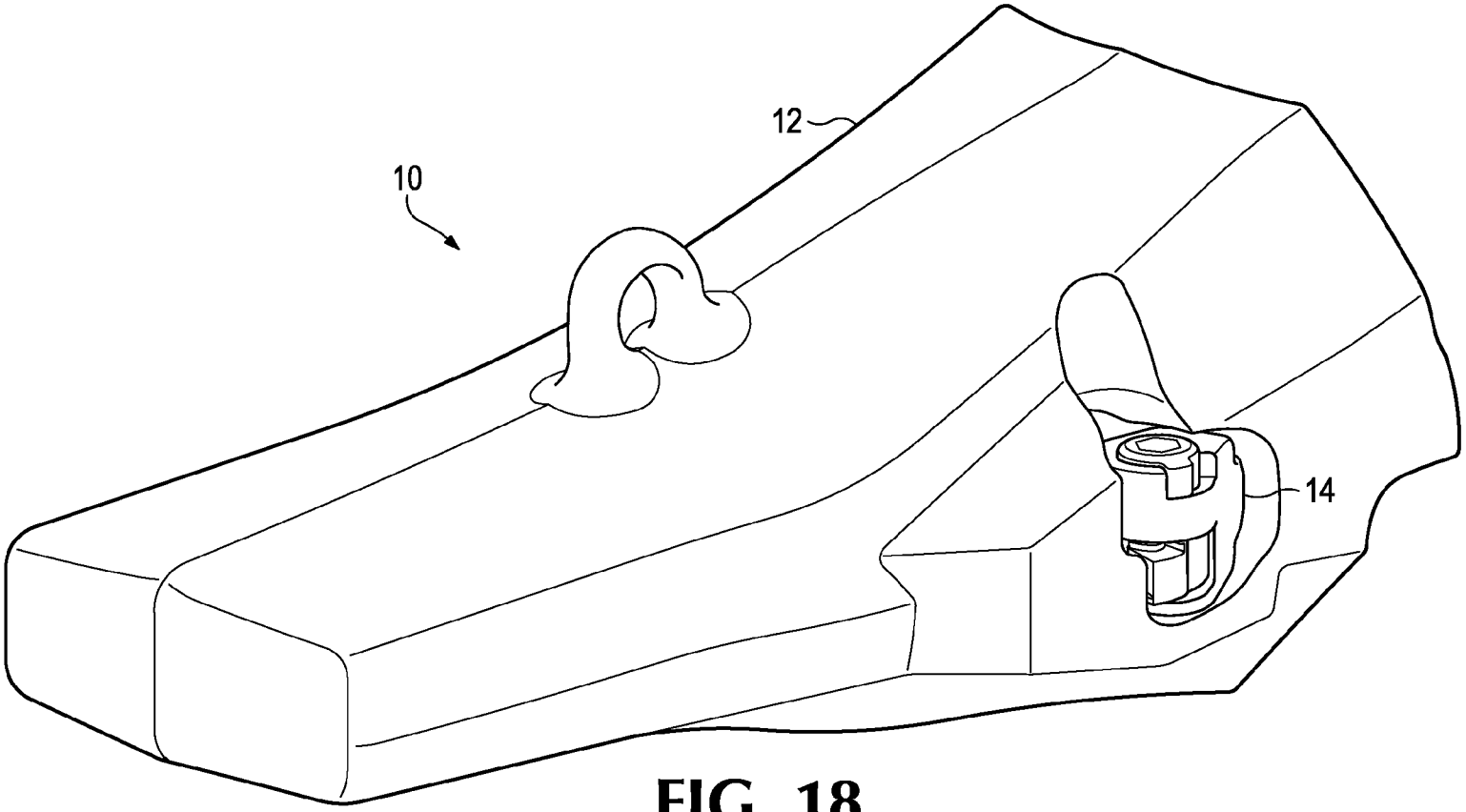
FIG. 18 is a perspective view of the wear member and lock of FIG. 1, showing the lock in the shipping position.
Figure 19:
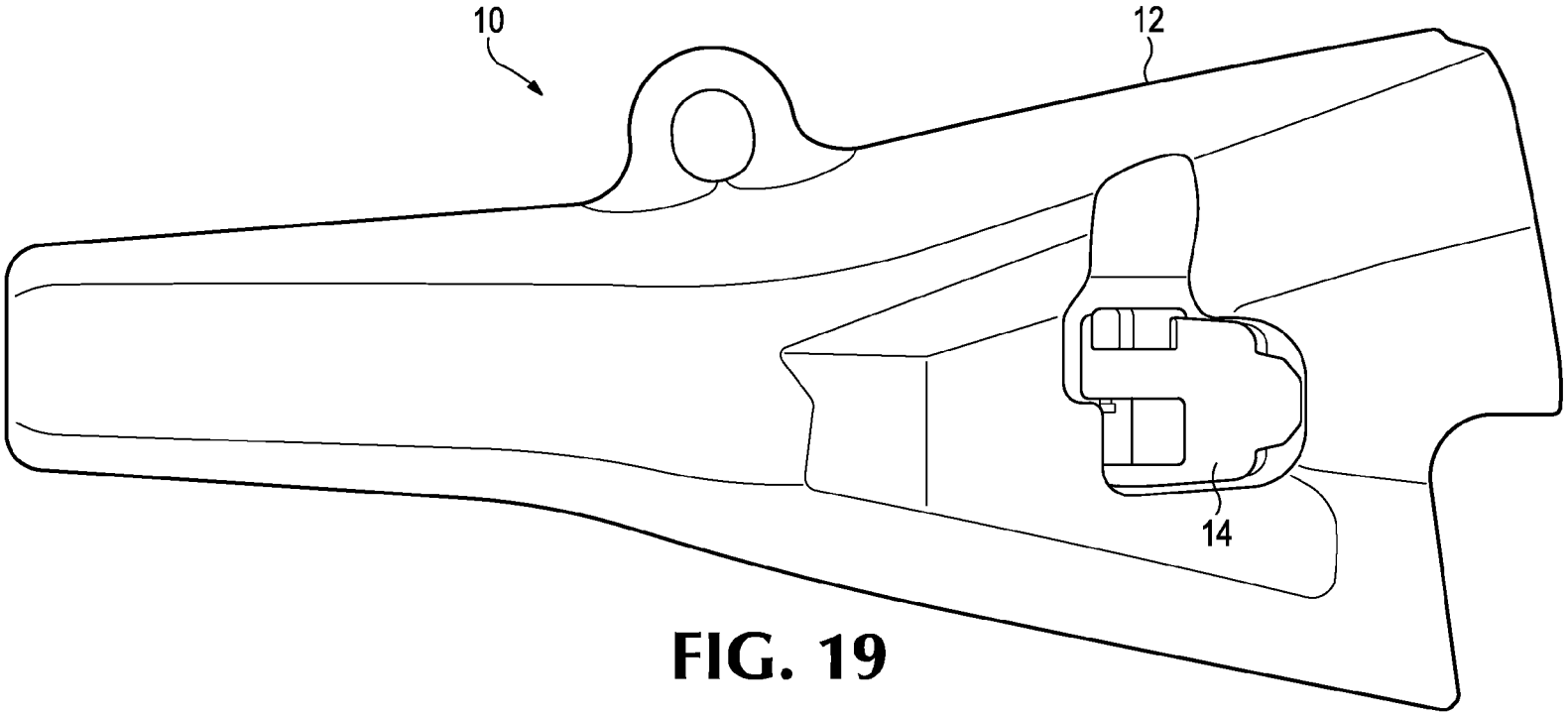
FIG. 19 is a right elevation view of the wear member and lock of FIG. 1, showing the lock in the installed position.
Figure 20:
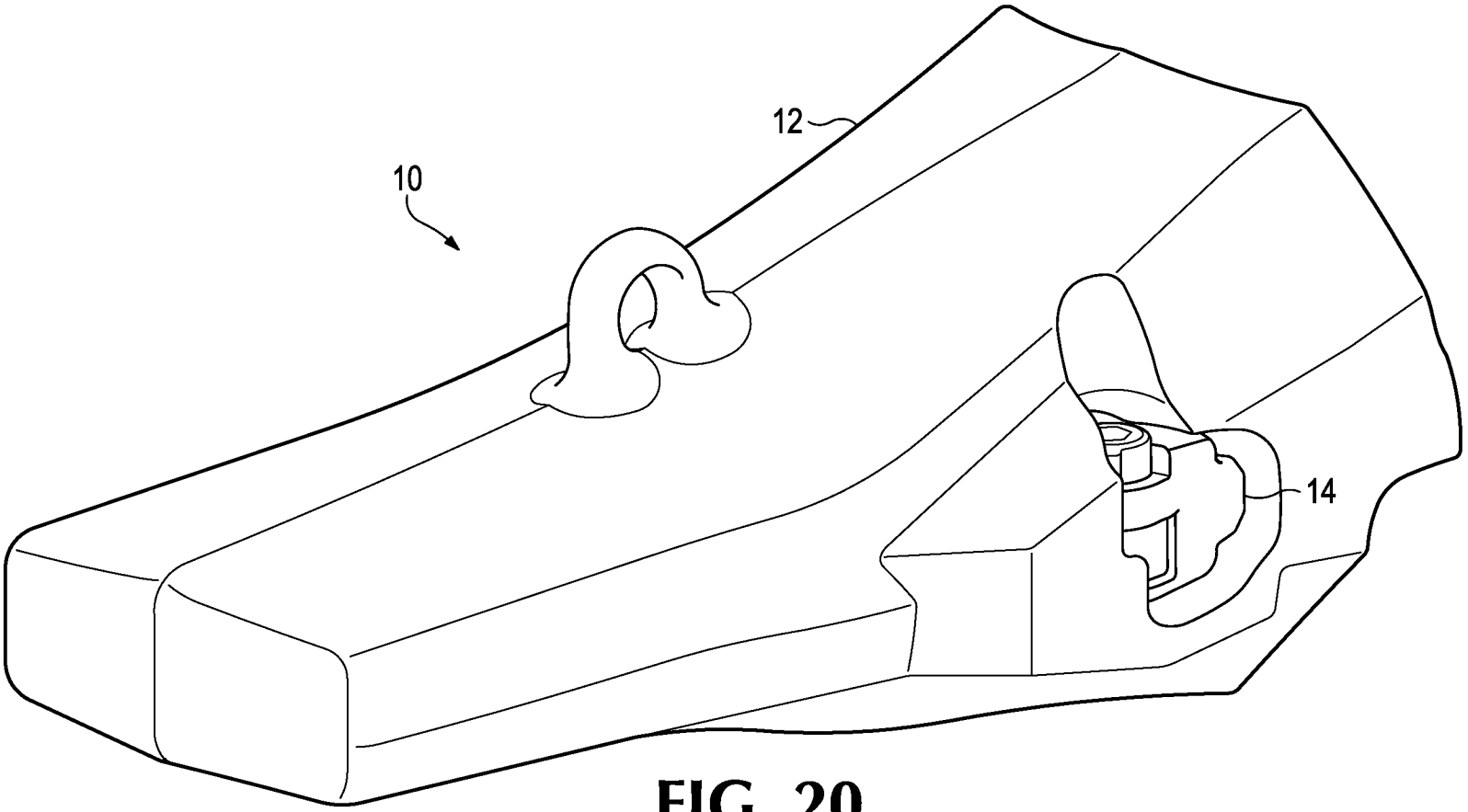
FIG. 20 is a perspective view of the wear member and lock of FIG. 1, showing the lock in the installed position.
Figure 21:
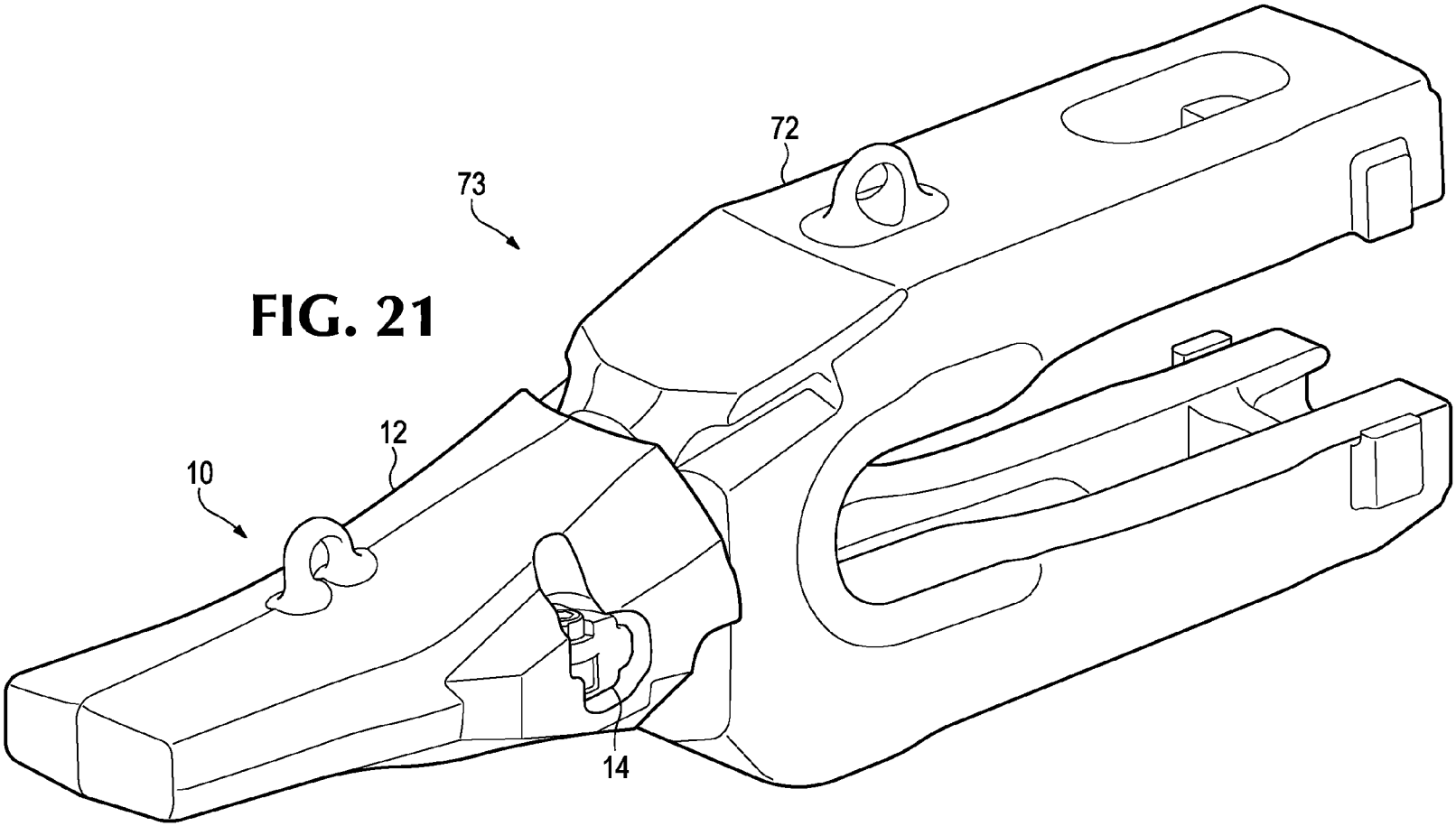
FIG. 21 is a perspective view of the wear assembly of FIG. 1, including the wear member and lock of FIG. 2, coupled to a base according to another embodiment of the present invention.

FIGS. 12 and 18 depict wear assembly 10 of FIG. 1 in the first position, where the latched lock 14 is partially inserted into the lock recess, so that it is retained by the front face 57 of latch member 22 and latch tooth 56, while FIGS. 19 and 20 show the lock 14 inserted into the lock recess of the wear member 12 and latched in the installed position. FIG. 21 shows wear member 12 with lock 14 in the installed position on an example embodiment of a base, in the form of an adapter 72, to form a wear assembly 73. Movement of the lock 14 (and particularly the lock body 18) with respect to the wear member 12 may be facilitated, in at least some examples of this invention, by interaction of lock body 18 surface 90 (FIG. 3C) with wear member 12 surface 92 (FIG. 1) (e.g., surface 92 of wear member 12 may support surface 90 of lock body 18 during sliding and rotational movement of the lock body 18 with respect to wear member 12).

Figure 22:
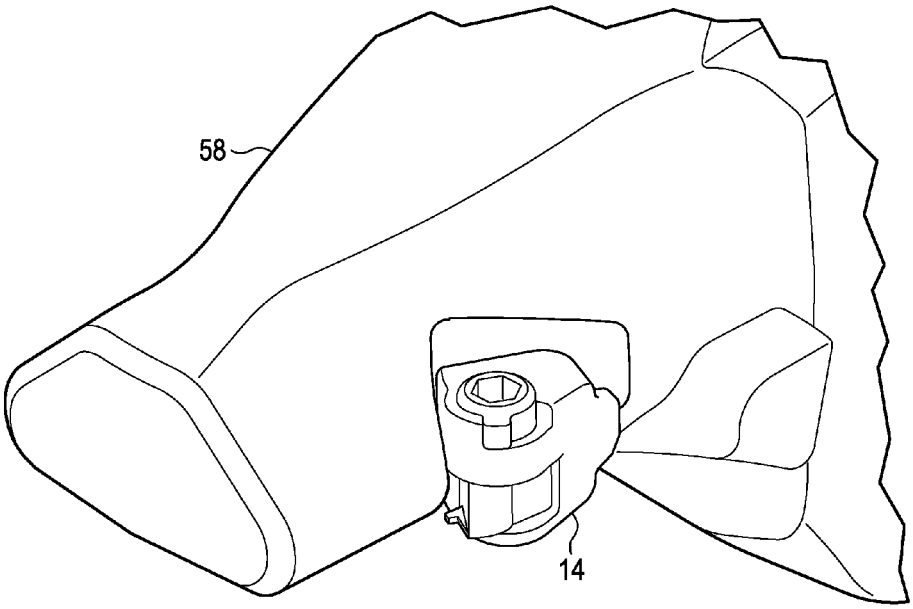
FIG. 22 is a partial perspective view of the lock of FIG. 1 in the latched configuration, and in the installed position, in association with the base of FIG. 10.
Figure 23:
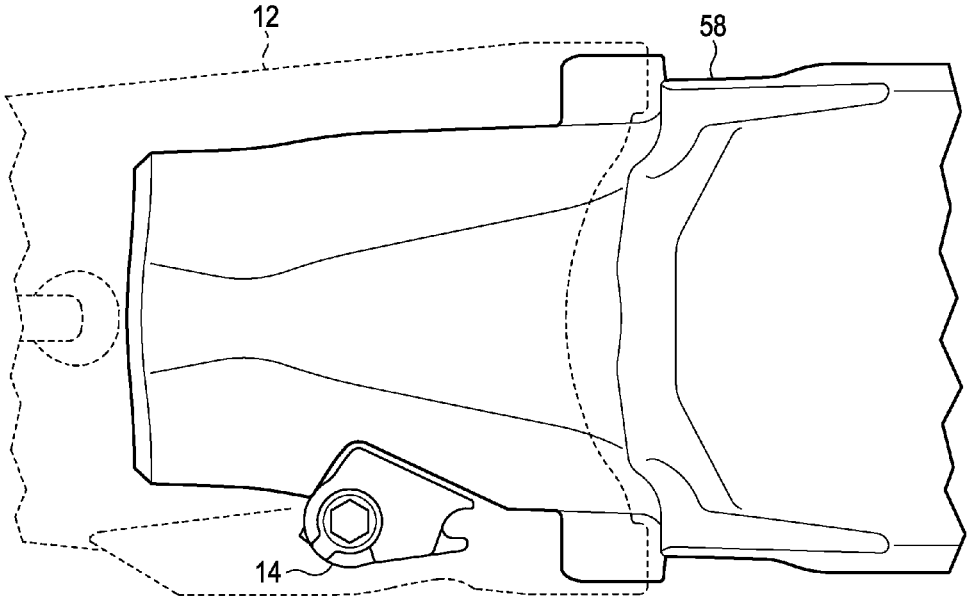
FIG. 23 is a partial plan view of the lock and base of FIG. 21 in combination with the wear member of FIG. 10 shown in broken lines.
Figure 24:
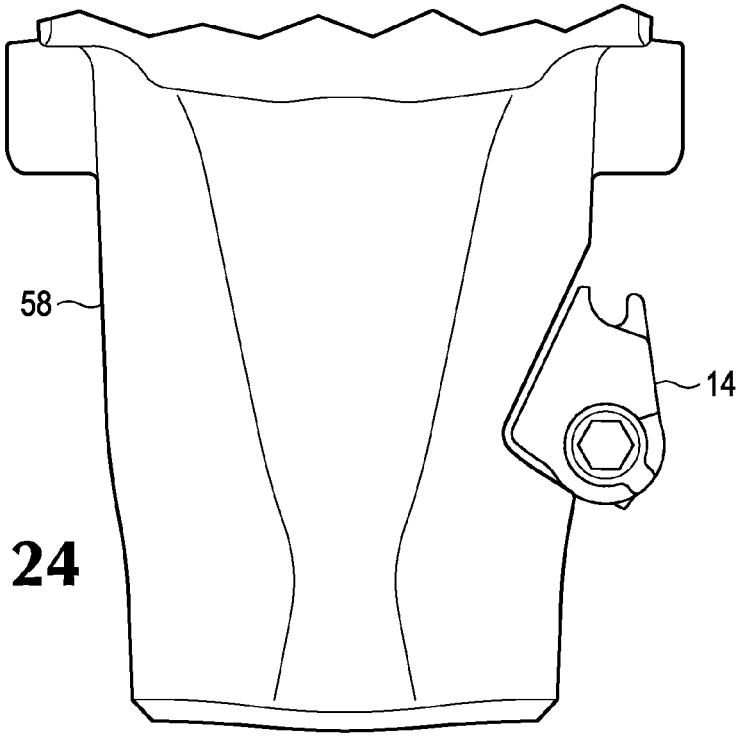
FIG. 24 is a partial plan view of the lock of FIG. 22 in the latched configuration, and in the installed position, in association with the base of FIG. 10.
Figure 25:
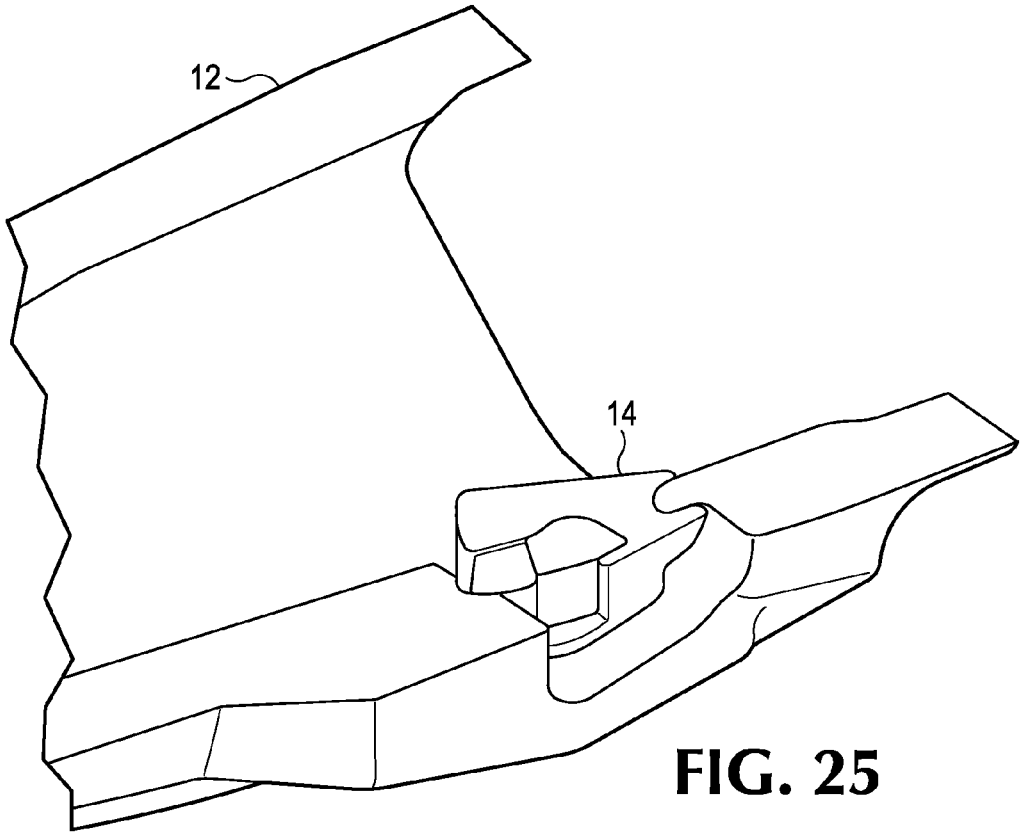
FIG. 25 is a partial perspective view of a horizontal section of the lock and wear member of FIG. 1.

For purposes of illustration, FIG. 22 shows lock 14 in the second or installed position in combination with base 58 and in the absence of wear member 12. In comparison, FIG. 23 shows lock 14 in the second or installed position in combination with base 58, with wear member 12 shown in broken lines. FIG. 24 shows lock 14 in the installed position in combination with base 58. FIG. 25 shows a cross-sectional view of the combination of lock 14 and wear member 12.

A single lock 14 is preferably used to secure the wear member to the base. Nevertheless, a pair of locks (e.g., one on each side) could be used, which may be beneficial for larger components such as intermediate adapters.

FIGS. 26A through 26H illustrate various views of another example lock 114 in accordance with this invention. Similar reference numbers are used in FIGS. 26A through 26H as used in the previous figures to refer to the same or similar features, but in FIGS. 26A through 26H, the "100 series" is used (e.g., if a feature with reference number "XX" is used in FIGS. 1-25, the same or similar feature may be shown in FIGS. 26A through 26H by reference number "1XX"). The detailed description of these same or similar features may be omitted, abbreviated, or at least somewhat shortened in order to avoid excessive repetition. The lock 114 of FIGS. 26A through 26H operates in a manner similar to the lock 14 of FIGS. 1 through 25, including the "two-phase" rotational install and removal feature, but its structure is somewhat different, as will be described in more detail below.

Figure 26A:
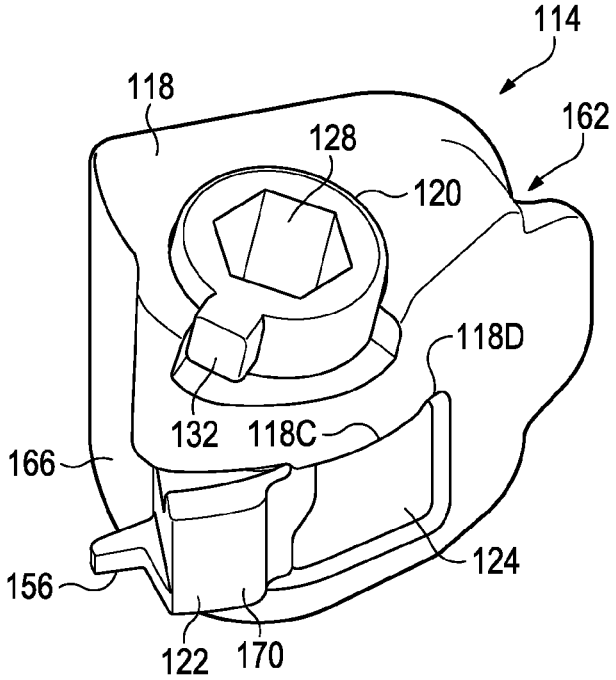
FIGS. 26A and 26B are perspective views of another example lock in accordance with this invention in a locked configuration and an unlocked configuration, respectively.
Figure 26B:
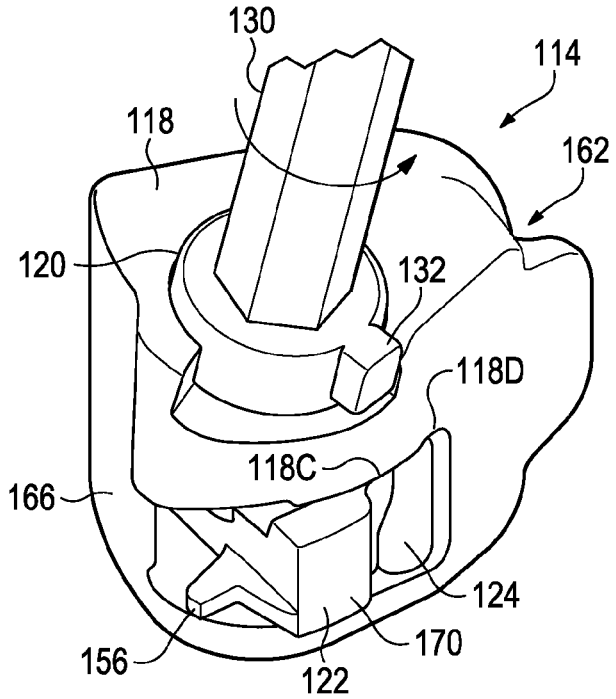
Figure 26C:
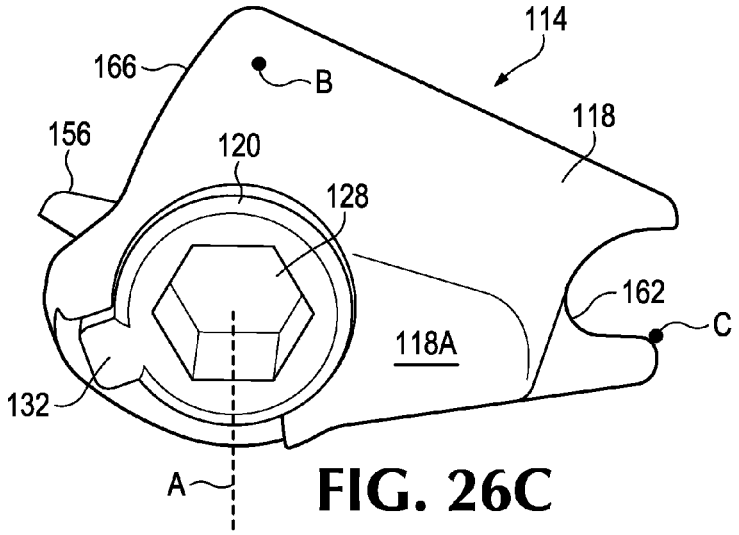
FIG. 26C is a top view and FIG. 26D is a side elevation view of this example lock.
Figure 26D:
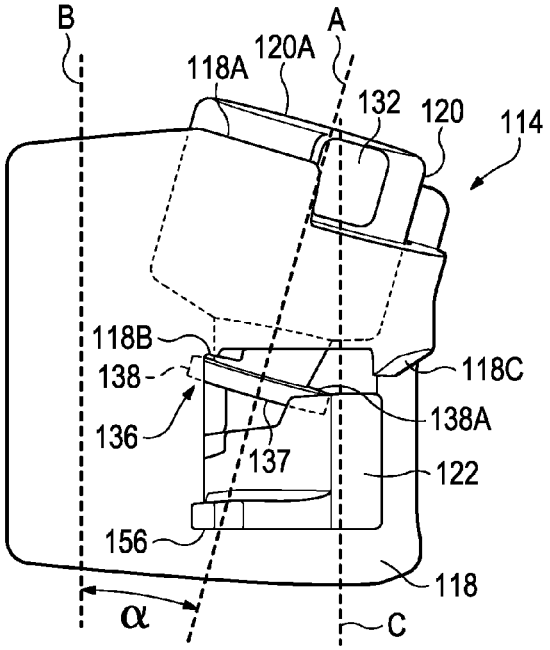
Figure 26E:
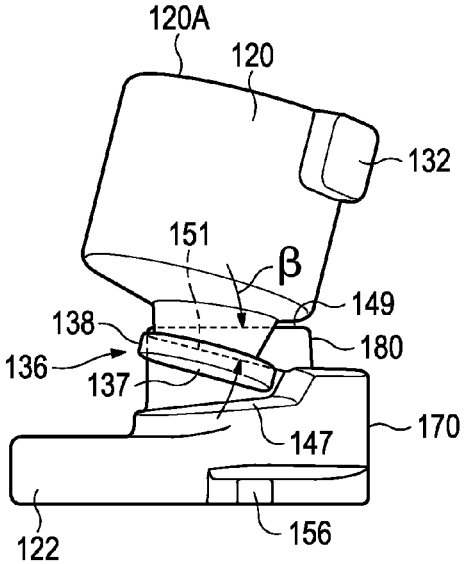
FIG. 26E illustrates the interaction between the actuator member and latch member of this example lock.
Figure 26F:
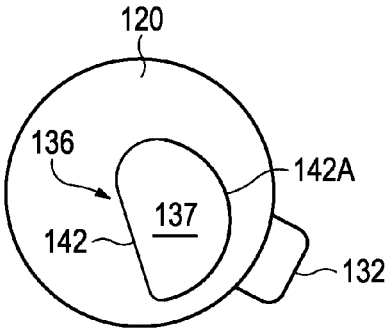
FIG. 26F is a bottom view of the actuator member of this example lock.
Figure 26G:
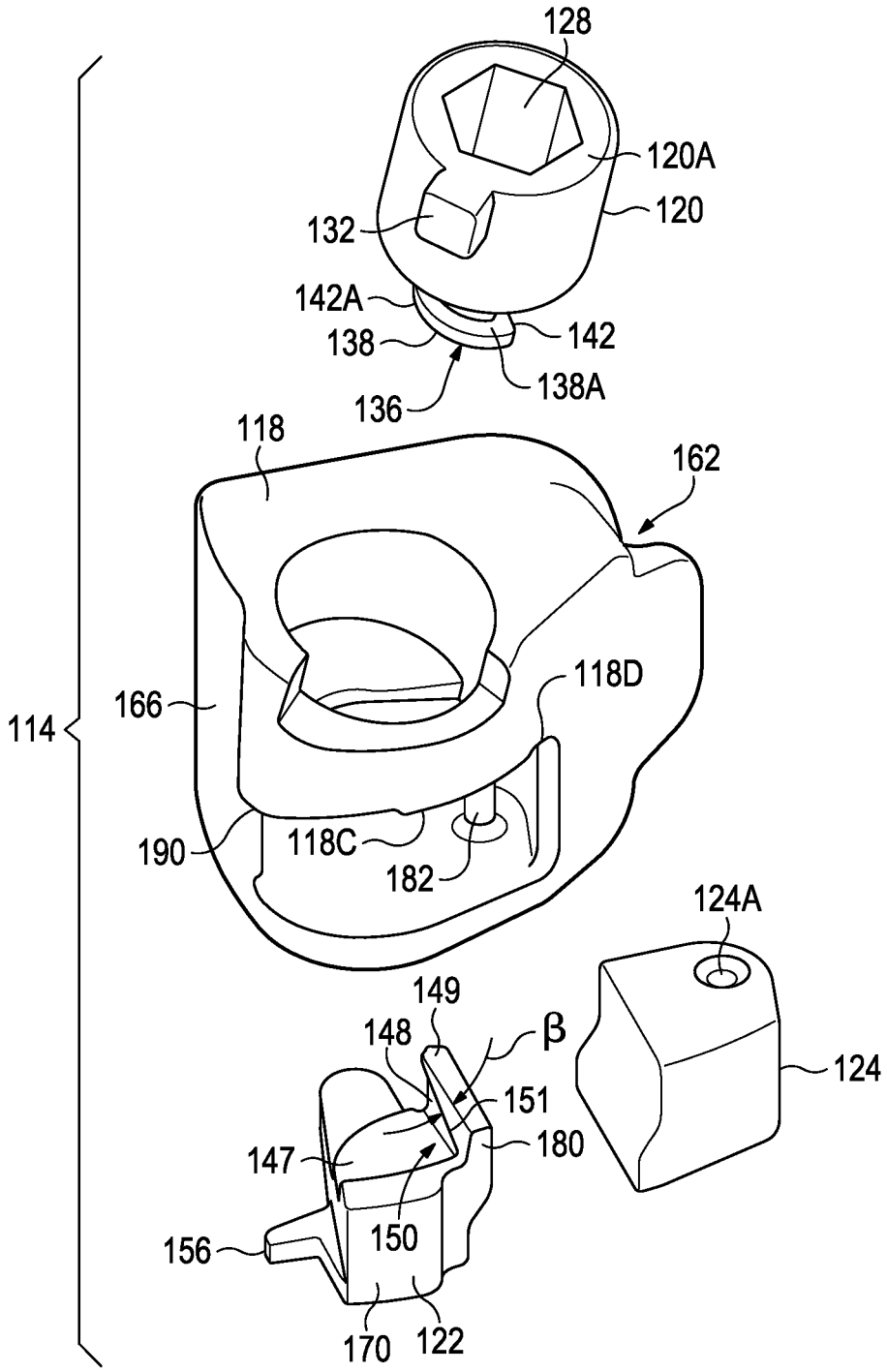
FIG. 26G is an exploded view of this example lock.
Figure 26H:
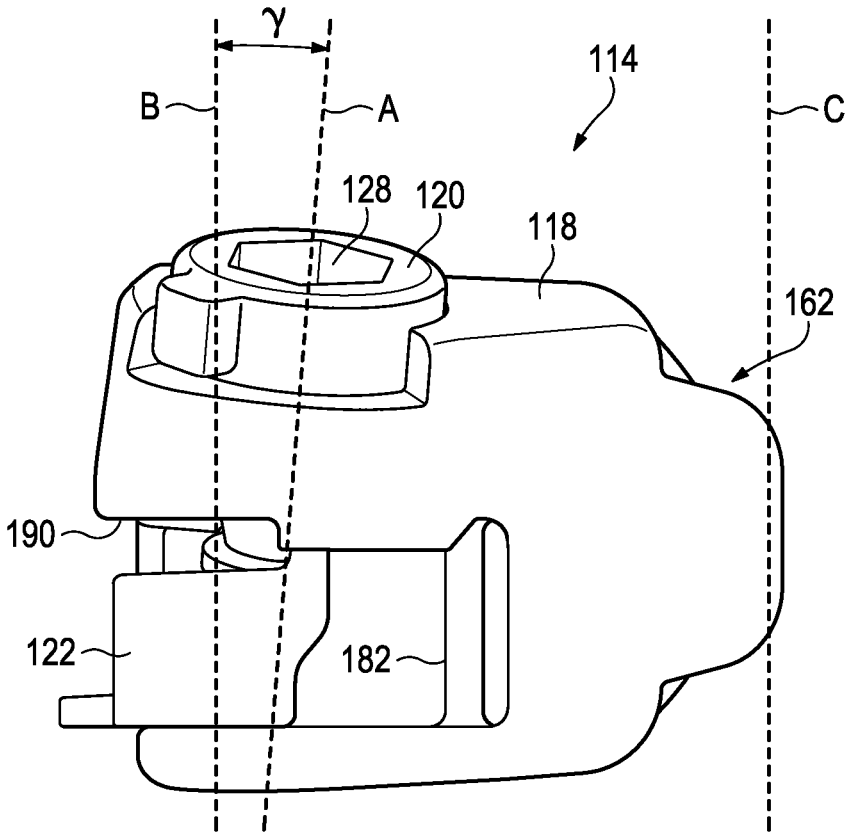
FIG. 26H is a front elevation view of this example lock.

FIGS. 26A and 26B show perspective views of the lock 114 in locked (FIG. 26A) and unlocked (FIG. 26B) conditions. FIG. 26C is a plan view and FIG. 26D is a side elevation view of the lock 114. FIG. 26E shows the actuating member 120 engaged with the latch member 122 without the lock body 118 present. FIG. 26F shows a bottom view of the actuator member 120, including a view of cam 136 and its flattened side surface 142. FIG. 26G is an exploded view of the lock 114 showing the various component parts. FIG. 26H is a front elevation view of the lock 114.

One difference between lock 114 of FIGS. 26A through 26H and the lock 14 described above relates to the structure and arrangement of actuator member 120. FIGS. 2 and 4 show actuating axis of rotation A, latching axis of rotation B, and locking axis of rotation C of the lock 14 as being parallel or substantially parallel (e.g., vertical in the illustrated orientations). This is not a requirement. Rather, in the lock 114 shown in FIG. 26D, the actuator 120 is oriented at an angle with respect to vertical (in the illustrated orientation) such that the actuating axis of rotation A is angled with respect to latching axis of rotation B and/or locking axis of rotation C. While this angle may take on a variety of different values, in some examples of this invention, the angle $\alpha$ between actuating axis A and latching axis B will be in a range of 0° to 45° as measured in a plane to which both axes are projected (e.g., as shown in FIG. 26D), and in some examples from 2° to 40°, from 5° to 35°, from 8° to 30°, or even from 10° to 30°. Similarly, in this illustrated example, the angle between actuating axis A and locking axis C will be in a range of 0° to 45° as measured in a plane to which both axes are projected (e.g., as shown in FIG. 26D), and in some examples from 2° to 40°, from 5° to 35°, from 8° to 30°, or even from 10° to 30°. In the example lock 14 of FIGS. 1 through 25, the angle $\alpha$ between axes A and B and axes A and C was at or about 0°. For one specific example of an angled lock according to this aspect of the invention, the lock 114 of FIGS. 26A through 26H will have an angle $\alpha$ of about 15° (e.g., for use with the shroud of FIGS. 28A through 28E), and in another example structure, the angle $\alpha$ is about 30° (e.g., for the shroud of FIGS. 29A through 29F). As further shown in FIG. 26D, the angle $\alpha$ is oriented so that the axis A extends away from and outside the lock 114 (and also in a direction away from a wear member 112 to which it is attached (see FIG. 27)) as one moves upward from the tool interface area 128.

FIG. 26D shows a front view of the lock 114 taken from the perspective of a plane parallel to axes B and C and parallel with a plane of flattened side surface 142 of cam 136 (described in more detail below). FIG. 26H shows a side view of the lock 114 taken from a point of view oriented 90° from the point of view of FIG. 26D (i.e., from the perspective of a plane parallel to axes B and C and perpendicular to the plane of flattened side surface 142 of cam 136). From this orientation, actuator axis A is oriented at an angle $\gamma$ with respect to axes B and C (which are vertical in this view). While this angle may take on a variety of different values, in some examples of this invention, the angle $\gamma$ between actuating axis A and latching axis B (and locking axis C) will be in a range of 0° to 15° as measured in a plane to which both axes are projected (e.g., as shown in FIG. 26H), and in some examples from 0.5° to 12°, from 1° to 10°, or even from 1.5° to 8°. In the example lock 14 of FIGS. 1 through 25, the angle $\alpha$ between axes A and B and axes A and C from this point of view is at or about 0°. For some specific examples of an angled lock according to this aspect of the invention, the lock 114 of FIGS. 26A through 26H will have an angle $\gamma$ of about 5°. As further shown in FIG. 26H, angle $\gamma$ orients axis A so as to extend toward axis C (and also in a direction toward anchor feature 162) and away from axis B as one moves upward from tool interface area 128; i.e., the axis for the actuating member is tilted outward and backward. This angle $\gamma$ feature of axis A helps keep the movement path of cam 136 straighter and/or more level with respect to the latch 122 during rotation of the lock 114 about actuator axis A as compared to the actuating member just being tilted outward.

Other changes in structure are provided in the lock 114 as compared to lock 14, e.g., at least in part to accommodate orienting the actuating axis A at a more pronounced angle from the other axes B and C. For example, as best shown in FIGS. 26C and 26D, the top surface of the lock body 118 includes an angled portion 118A at the area including the recess in which the actuator member 120 is inserted (the top surface of lock body 18 was flat or substantially flat, e.g., as shown in FIGS. 3A and 3C). This feature highlights some potential advantages of this example lock structure 114. For example, because the actuating axis A extends outward and away from the lock 114 and away from the wear member 112 to which it is attached, the axis of the actuator tool 130 also will extend outward and away from the lock 114 and away from the wear member 112 when it is engaged with the tool interface 128. This angling can provide more room for the operator when engaging the tool 130 with the lock 114 and more room for rotating the tool 130 to secure or release the wear member 112 from the base 158.

Also, the angling feature allows some changes to be made to the lock recess 116 of the wear member 112. This can be seen, for example, in a comparison of FIGS. 1 and 27. In the example of FIG. 1, the tool 30 engages the tool interface 28 in a substantially vertical direction (in the illustrated orientation). Therefore, in this arrangement, the interior back wall 16B at the top portion 16A of the lock recess 16 extends more vertically into the wear member 12 (or even angled into the interior of the wear member 12) based on the orientation shown in FIG. 1 (and thus extends further into the side edge of the wear member 12 in the side-to-side direction D). In other words, the interior back wall 16B extends in a direction substantially parallel to a vertical plane running through a center line of the wear member 12 (based on the orientation shown in FIG. 1), or even angled inward toward the center line of the wear member 12. In some structures, to provide sufficient tool access, interior back wall 16B may be angled to extend from 10°-30° into the side of (and toward the center line of) the wear member 12.

Figure 27:
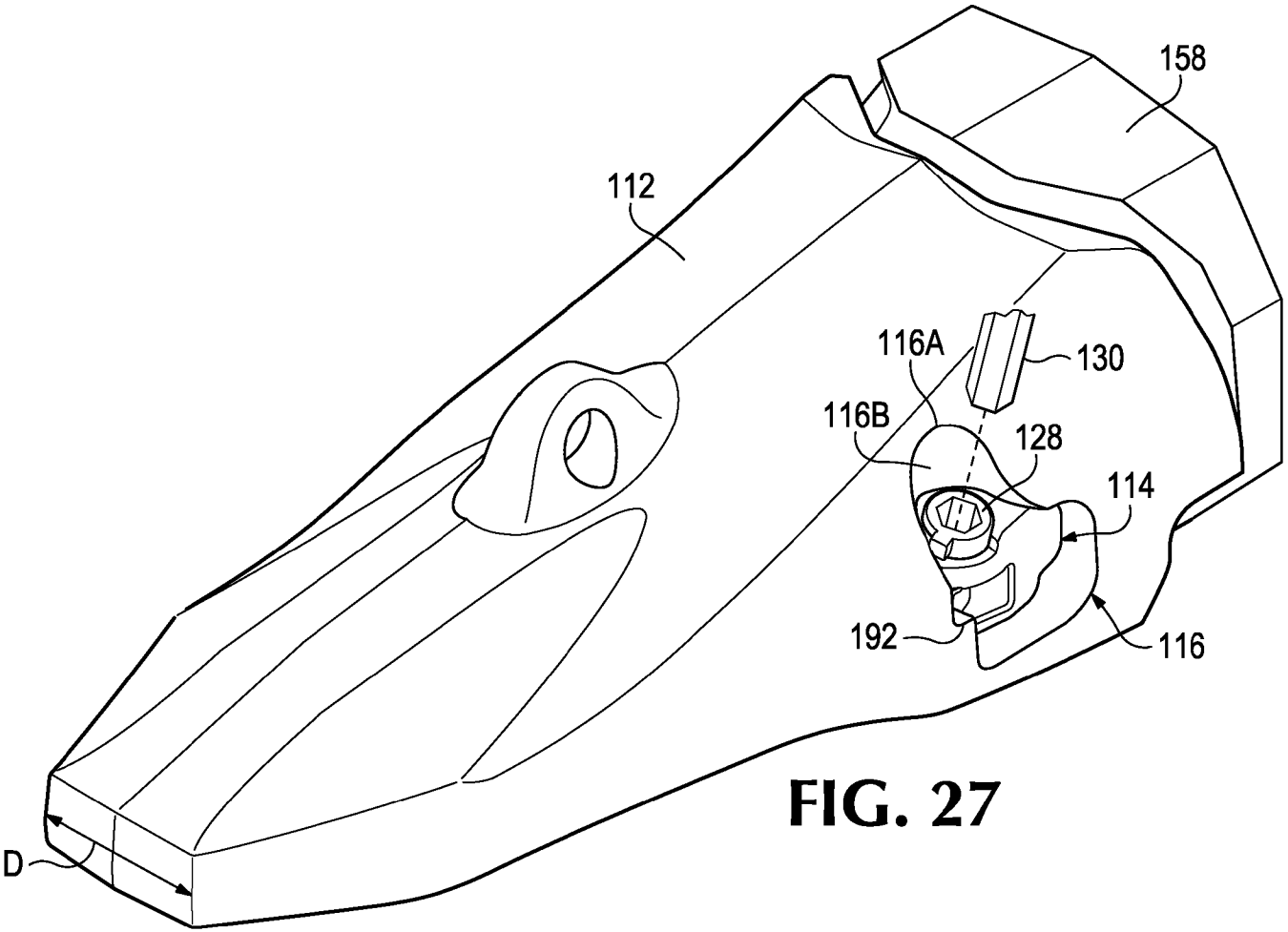
FIG. 27 is a perspective view showing the lock of FIGS. 26A through 26H mounted to a point and base.

By angling a portion of the top surface 118A of the lock body 118, however, the lock recess 116 need not extend as deeply into the wear member 112 in the side-to-side direction D, as shown by the location of top portion 116A of lock recess 116 in FIG. 27. Therefore, in this example structure, the interior back wall 116B at the top portion 116A of the lock recess 116 extends in a non-vertical direction (based on the orientation shown in FIG. 27). In other words, the interior back wall 116B extends in an outwardly angled direction with respect to a vertical plane running through a center line of the wear member 112 (based on the orientation shown in FIG. 27) and/or in a direction away from this center line. This angle may be within the ranges described for angle $\alpha$ above. This angling of the tool 130 entry area of the lock recess 116 allows additional wear member material and thickness to be provided at the location of the lock, which may lead to longer wear member life and/or reduced failures.

The actuator member 120 angling feature also leads to changes in other portions of this example lock 114 structure. Actuator 120 includes tab 132 extending sideways from a top surface thereof and a cam 136 extending downward from a bottom surface thereof. The cam 136 includes a lower face 137 and a flange 138. While the lower face 137 and the top surface of flange 138 (which engages the latch 122, as discussed below) may be parallel to one another, this is not a requirement. For example, the top surface of flange 138 may slope upward toward the top of the actuator 122 as the top surface extends from its outer side edge toward its center, e.g., at an angle up to 5°, if desired. One side of the lower face 137 includes a flatten side edge 142 to produce a substantially hemi-circular shaped lower face 137. As shown in FIGS. 26D and 26E, the cam lower face 137 and the flange 138 upper surface 138A of this example structure 120 may be parallel or substantially parallel to a top surface 120A of the actuator (and perpendicular or substantially perpendicular to actuating axis A). Therefore, this lower face 137 and upper surface 138A are oriented at a non-perpendicular angle with respect to the latching axis B and the locking axis C.

Latch member 122 includes changes to various surfaces to accommodate the structural changes to actuator member 120. Like latch member 22, latch member 122 includes a latch tooth 156 and other latching features that operate in the same or a similar manner to those of latch member 22 described above. The cam 136 engaging features of latch member 122, however, differ somewhat from those of latch member 22. For example, as shown in FIGS. 26D, 26E, and 26G, the latch member 122 includes a base surface 147, a side wall 148 (e.g., vertical or substantially vertical) extending from the base surface 147, and an upper shelf 149 that extends over the side wall 148 to define a channel 150. The channel 150 extends from the base surface 147, along wall 148, and terminates at angled top wall 151. The angle of the top wall 151 of the channel 150 with respect to the upper shelf 149 (angle $\beta$) (and/or with respect to a plane perpendicular to axis B and/or C) may be within the ranges described for angle $\alpha$ above.

In use, with the actuator 120 in the locked position (e.g., FIG. 26A), the flattened side edge 142 of cam 136 is received within the channel 150 defined in the latch member 122 (and optionally, the flattened side edge 142 may contact or lie closely adjacent to the wall 148 in channel 150). In this position, the actuator 120 is held in place with respect to the lock body 118 by: (a) contact between the top surface 138A of flange 138 and the underside of top wall 151 and/or (b) contact between the top 138A of flange 138 and lip or overhang area 118B of lock body 118. The latch mechanism 122 also is held in place with respect to lock body 118 (and prevented from sideways ejection therefrom) in this position by contact between the side edge 180 of latch mechanism 122 and an overhang portion 118C of the lock body 118. When the actuator 120 is rotated to the unlocked position (e.g., FIG. 26B), the rounded portion 142A of the cam flange 138 rotates into the channel 150 (beneath top wall 151) to push the latch member 122 counterclockwise (when viewed from above) and against resilient body 124. A notch 118D in the far right edge of overhang portion 118C is provided to allow for initial insertion of the latch member 122 into the lock body 118 (i.e., to allow clearance for side edge 180 and upper shelf 149).

FIG. 26G shows additional details regarding the interior of the recess of the lock body 118 in which the latch member 122 and resilient member 124 are received. More specifically, as shown in FIG. 26G, the interior recess of this example structure includes a support member 182 for supporting resilient member 124 (which may be formed from a rubber material, such as vulcanized rubber). The resilient member 124 may be formed separately and engaged with this support member 182, or it may be formed in place (e.g., by introducing a flowable polymer material into the recess after the actuator member 120 and the latch member 122 are in place within the recess and moved to the locked position (e.g., as shown in FIG. 26A) and then having the polymer material harden in place). In either manner, the support member 182 helps maintain the resilient member 124 within the lock body 118 recess. Opening 124A is shown in FIG. 26G to illustrate where support member 182 engages resilient member 124. More support members, in different locations, may be provided, if desired, without departing from the invention. Alternatively, if desired, support member 182 may be omitted (and the resilient member 124 may be held in place by a friction fit, by expanding behind wall ledges, etc.). As another option, if desired, the resilient member 124 may be held in place, at least in part, by an adhesive.

This lock 114 may be mounted to a wear member 112 (e.g., a point) and/or locked to a base member 158 in the same manner as described above for the lock 14. More specifically, the lock 114 may be mounted to a wear member 112 for shipping, storage and installation, and/or engaged with a wear member 112 and a base member 158 in a locking manner. FIGS. 26A through 26C show an anchor feature 162 on lock body 118 that may engage a support like support 64 provided on a wear member 12 in the manner described above. The lock body 118 includes features (e.g., bearing surface 166) for engaging with corresponding features or bearing on surfaces on wear member 112 and/or base member 158 in the manner described above. The latch member 122 includes features (e.g., latch tooth 156 and various bearing surfaces) for engaging with corresponding features or bearing on surfaces on wear member 112 in the manner described above.

As described above, FIG. 27 illustrates the lock 114 of this example of the invention engaged with a point type wear member 112. In use, movement of the lock 114 (and particularly the lock body 118) with respect to the wear member 112 may be facilitated, in at least some examples of this invention, by interaction of lock body 118 surface 190 (FIGS. 26G and 26H) with wear member 112 surface 192 (FIG. 27) (e.g., surface 192 of wear member 112 may support surface 190 of lock body 118 during sliding and rotational movement of the lock body 118 with respect to wear member 112).

Figure 28A:
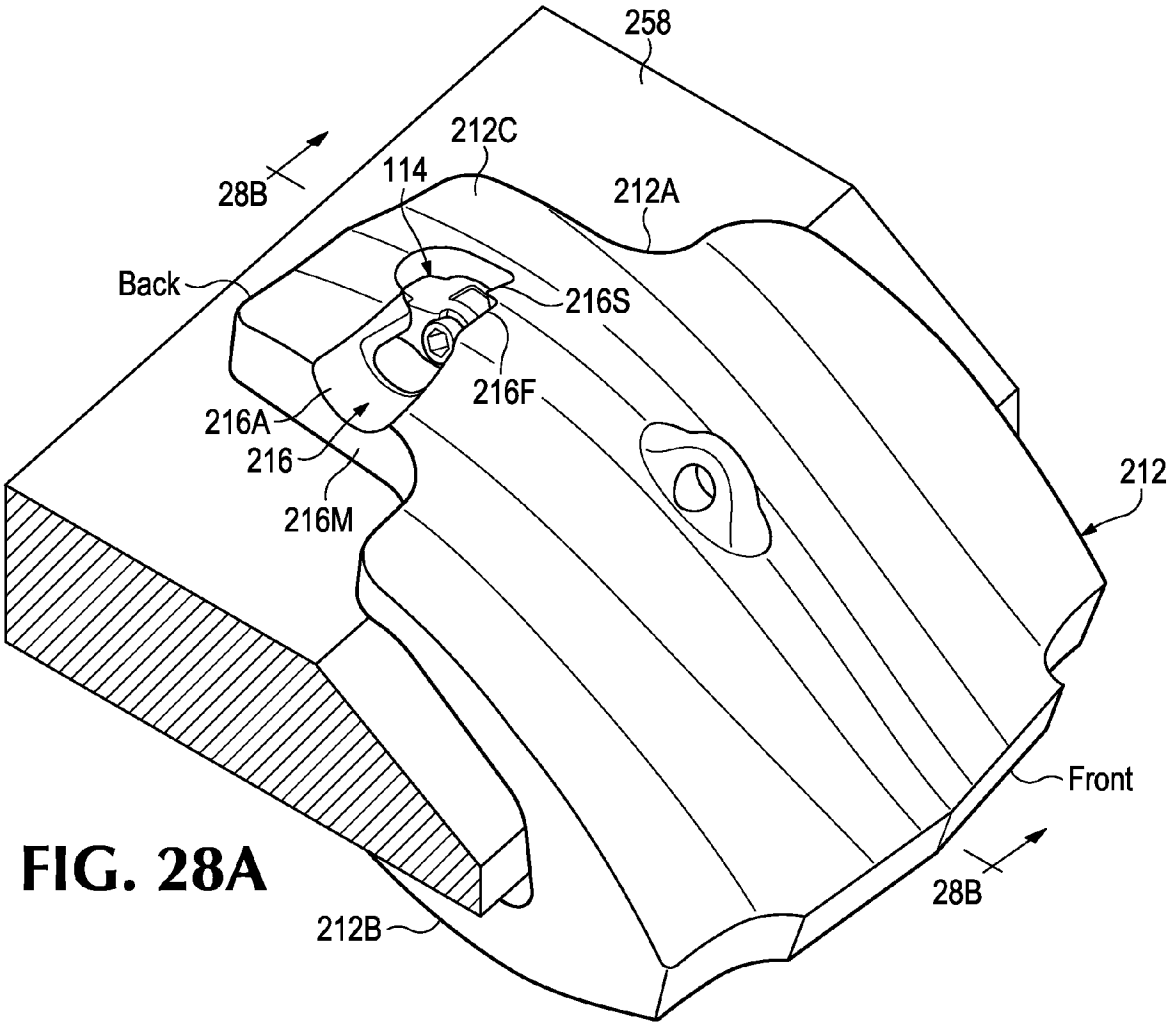
FIG. 28A is a perspective view of a shroud type wear member engaged with a base using a lock of the type shown in FIGS. 26A through 26H.
Figure 28B:
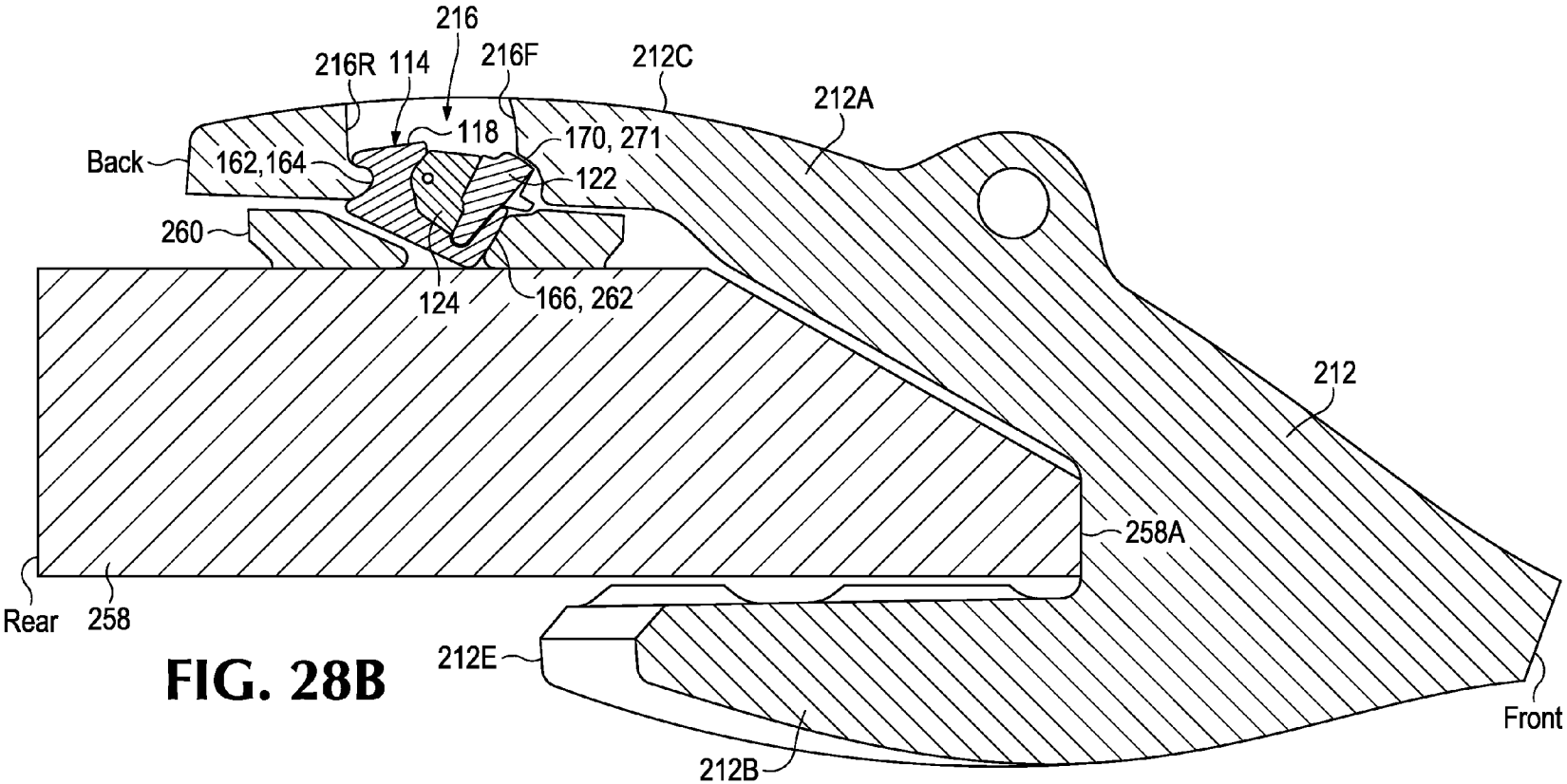
FIG. 28B is a cross sectional view along lines 28B-28B of FIG. 28A.
Figure 28C:
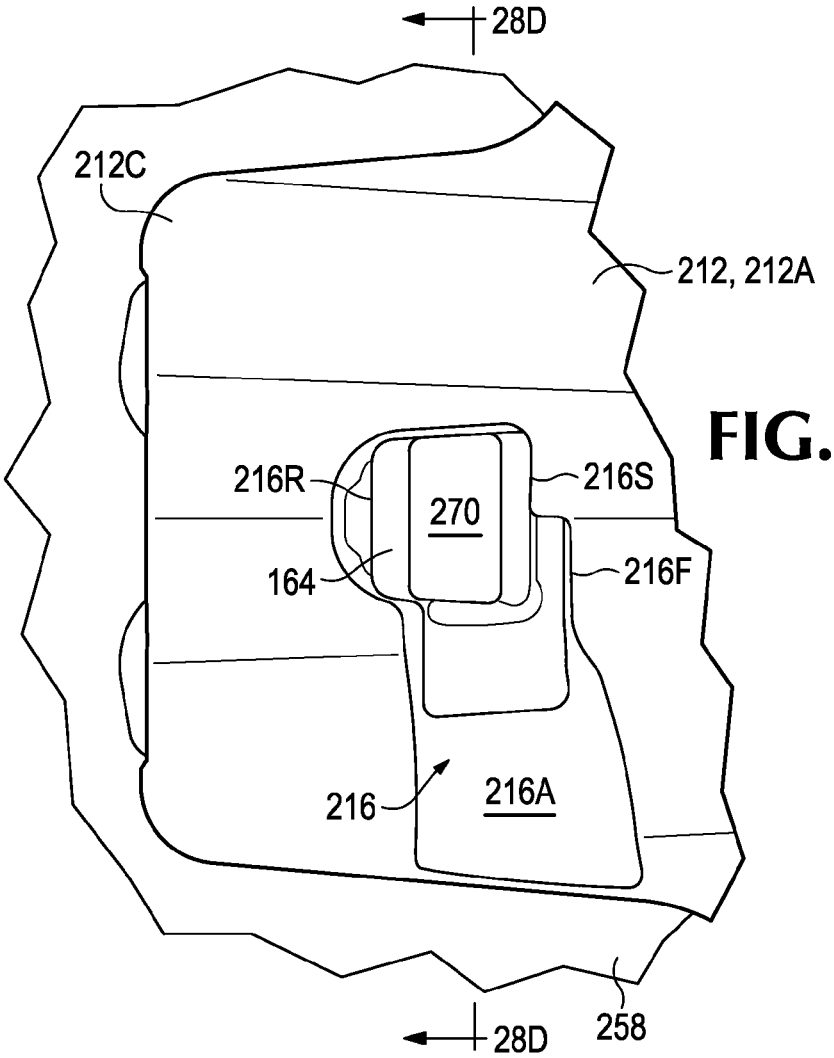
FIGS. 28C through 28E show top, cross section, and bottom views, respectively, of this example shroud and its lock recess area.
Figure 28D:
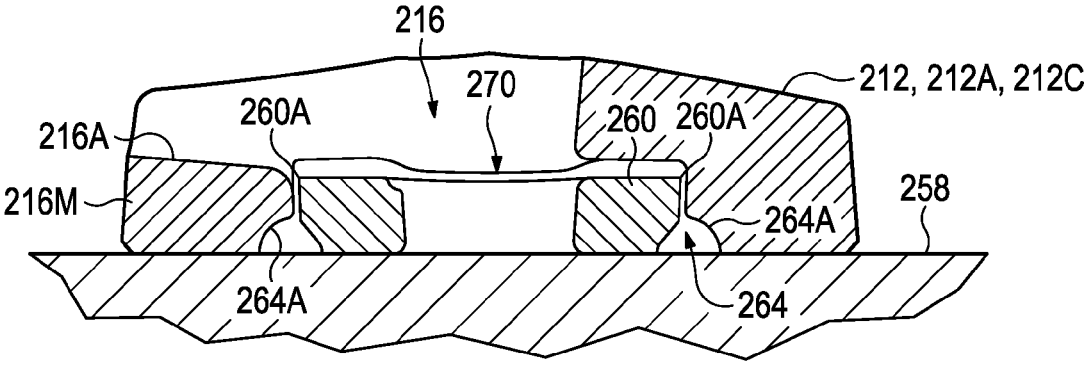
Figure 28E:
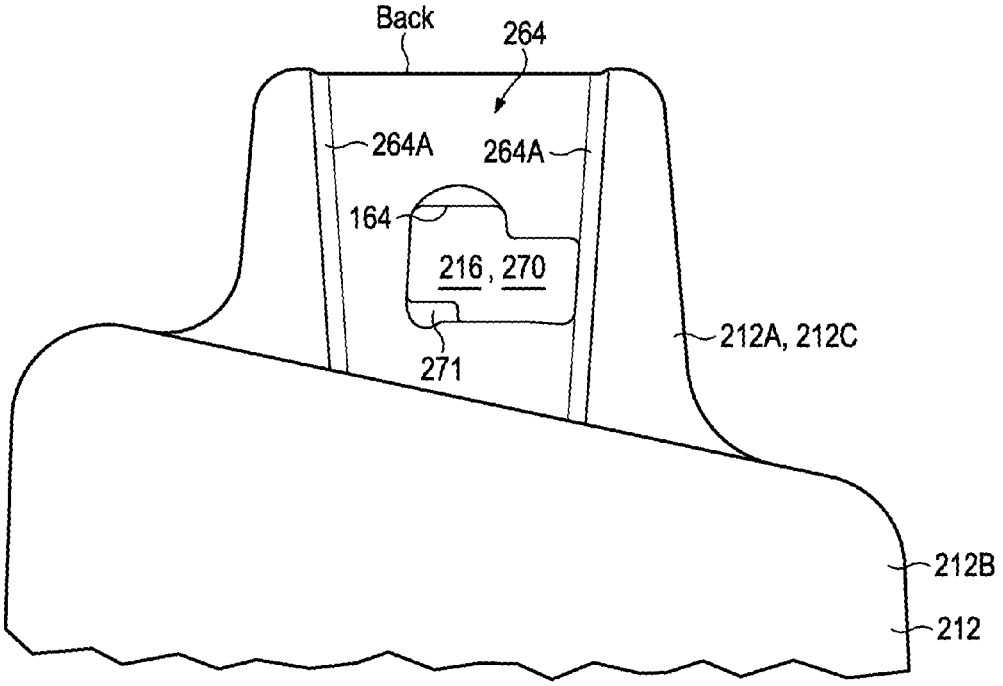

The lock 114 may be used in other environments as well. FIGS. 28A and 28B illustrate a lock 114 of the type described above used in engaging a shroud-type wear member 212 (also called a "shroud" herein) with a base 258 (such as a lip). FIGS. 28C and 28D show the wear member 212 and the base 258 with the lock 114 omitted, to better illustrate various surfaces and features of the lock recess 216 in the wear member 212. FIG. 28E shows a bottom view of the shroud 212, to show additional details of the underside of top leg 212A and the lock recess 216 provided therein. As shown in these figures, the lock recess 216 is provided on an extended portion 212C of top leg 212A that extends rearward (and over base member 258) beyond an outer edge 212E of bottom leg 212B.

As shown in FIGS. 28A, 28B, and 28D, the front edge of the base 258 (such as a lip) may be equipped with a boss 260 for engaging a shroud 212 (e.g., typically secured to the base member 258 by welding, but may be secured in other manners, if practical and desired). In this illustrated example, and as best shown in FIGS. 28D and 28E, the underside of the extended portion 212C of the top leg 212A includes a recessed channel 264 that slides over and around the boss 260. This channel 264 may decrease in side-to-side width from the back-to-front direction, as shown by the tapered side walls 264A in FIG. 28E, but could also be parallel. If desired, at least the rearmost portion of the recess 264 may be somewhat wider at its very top than at its center and/or bottom (e.g., with tapered side walls in the vertical direction, with protruding rails defined by the side walls, etc.) to provide a dovetailing feature for engaging the boss 260. Alternatively, the recess 264 and boss 260 could have complementary T-shapes or other interlocking configurations. Close clearance and/or contact between side walls 264A and outside walls 260A of the boss 260 can help protect the lock 114 and prevent side-to-side movement of the shroud 112 with respect to the base member 158.

As best shown in FIG. 28B, in the locked configuration, surface 166 of lock 114 engages a corresponding front bearing surface 262 on the boss 260 of base 258 to prevent the shroud 212 from pulling away from the front edge 258A of the base 258. These same surfaces 166 and 262, along with interaction between the anchor feature 162 of the lock body 118 and the support 164 at the rear wall 216R of the lock recess 216 prevent horizontal movement of the lock 114 with respect to the shroud 212 and the base 258. The anchor 162 may have a rounded recess and the support 164 may have a rounded cross sectional shape, e.g., like components 62 and 64 described in more detail above. Interaction between the anchor 162 of the lock body 118 and the support 164 at the rear wall 216R of the lock recess 216 along with interaction between the latch 122 shoulder 170 and bearing surface 271 of the shroud 212 prevent ejection of the lock 114 from the lock recess 216 in the vertical direction (with respect to the orientation shown in FIG. 28B).

Features of the lock recess 216 will be described in more detail below. As shown in FIGS. 28A and 28C, the side area of the extended portion 212C of the top leg 212A includes a cut out entry port or recessed area to allow access for a tool (e.g., tool 30, 130) to rotate the actuator member 120 of lock 114. Because of the angled orientation of the actuating axis A with respect to the latching axis B and/or the locking axis C as described above, the bottom surface 216A of this entry port area may be angled somewhat upward and/or away from the top major surface of the base member 258. These angling features can provide more room for operation of the tool 130 (i.e., because the tool 130 handle will be raised somewhat higher above the surface of base member 258 as compared to the location of the handle if the tool extended away from the actuator 120 in a horizontal manner or in a direction substantially parallel to the top surface of base member 258). These angling features also allow a manufacturer to provide a greater thickness of shroud material 212M below the bottom surface 216A of the tool insert port, which can help provide longer life and greater resistance to cracking or failure at the lock entry port area.

The entry port area of this example shroud 212 opens into a lock receiving opening 270, a portion of which extends completely through the extended portion 212C of the top leg 212A. This lock receiving opening 270 allows a portion of the lock 114 to extend through the shroud 212 and into position to engage the boss 260 (as shown in FIG. 28B).

As noted above, the support feature 164 at the rear wall area 216R of the lock recess 216 may have a rounded cross sectional shape, e.g., like component 64 described in more detail above. Although it need not do so, in this illustrated example structure, this support feature 164 extends across the entire rear width of lock receiving opening 270 and juts forward from the rear wall 216R. If desired, the support 164 could be provided across just a portion of the rear wall 216R in the side-to-side direction (e.g., a central portion, a portion offset to one side or the other, etc.) or the support 164 could be provided at multiple separated locations across the back of the lock receiving opening 270. Also, if desired, the rounded cross sectional support (e.g., like feature 164) could be provided on the lock body 118 and the groove that receives this feature (e.g., like groove 162) could be provided as part of the back wall of the lock receiving opening 270.

The front wall 216F of the lock recess 216 includes a rearward extending portion 216S that is flush or contiguous with the top surface of leg 212A, but this rearward extending portion 216S is undercut to provide the bearing surface 271 for engaging the shoulder 170 of latch 122 (e.g., see FIG. 28B). This undercut bearing surface 271 also is provided for engaging the latch tooth 156 when the lock 114 is mounted to the shroud 212 in a first position, e.g., as described above in conjunction with FIG. 12. The rearward extending portion 216S of the front wall 216F and the undercut area relating to it may extend any desired proportion of the width of the lock receiving opening 270, but in this illustrated example, these features extend along approximately 25% to 60% of the overall hole 270 width.

While FIGS. 28A through 28D illustrate a shroud 212 engaged with a base member 258 via a welded on (or otherwise attached) boss 260, a separately-formed boss may be omitted, if desired. For example, if desired, the top surface of base member 258 could be formed to include surfaces for engaging the lock 114 (e.g., either built up on the top surface or recessed into the top surface of base member 258).

Figure 29A:
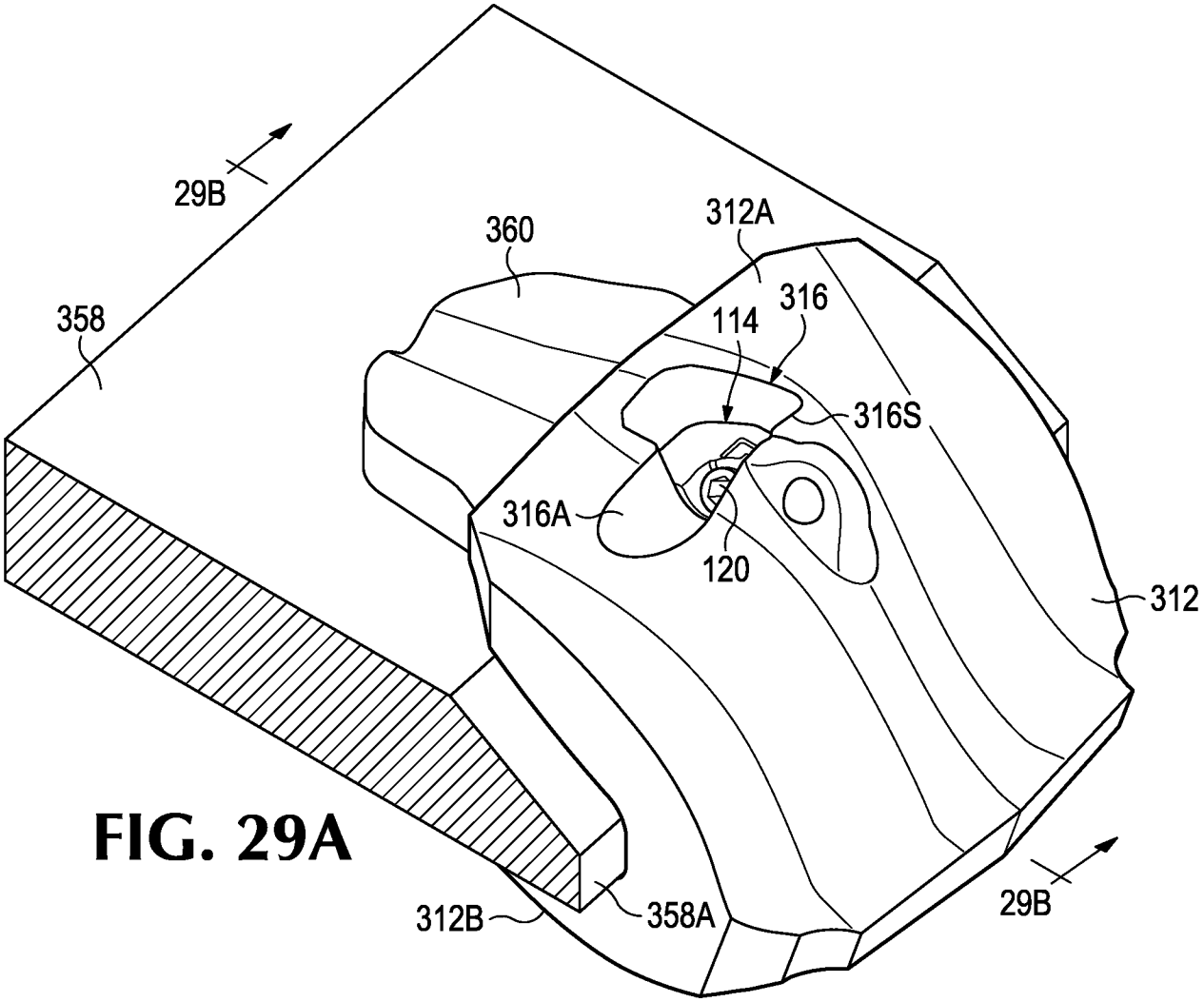
FIG. 29A is a perspective view of another shroud type wear member engaged with a base member using a lock of the type shown in FIGS. 26A through 26H.
Figure 29B:
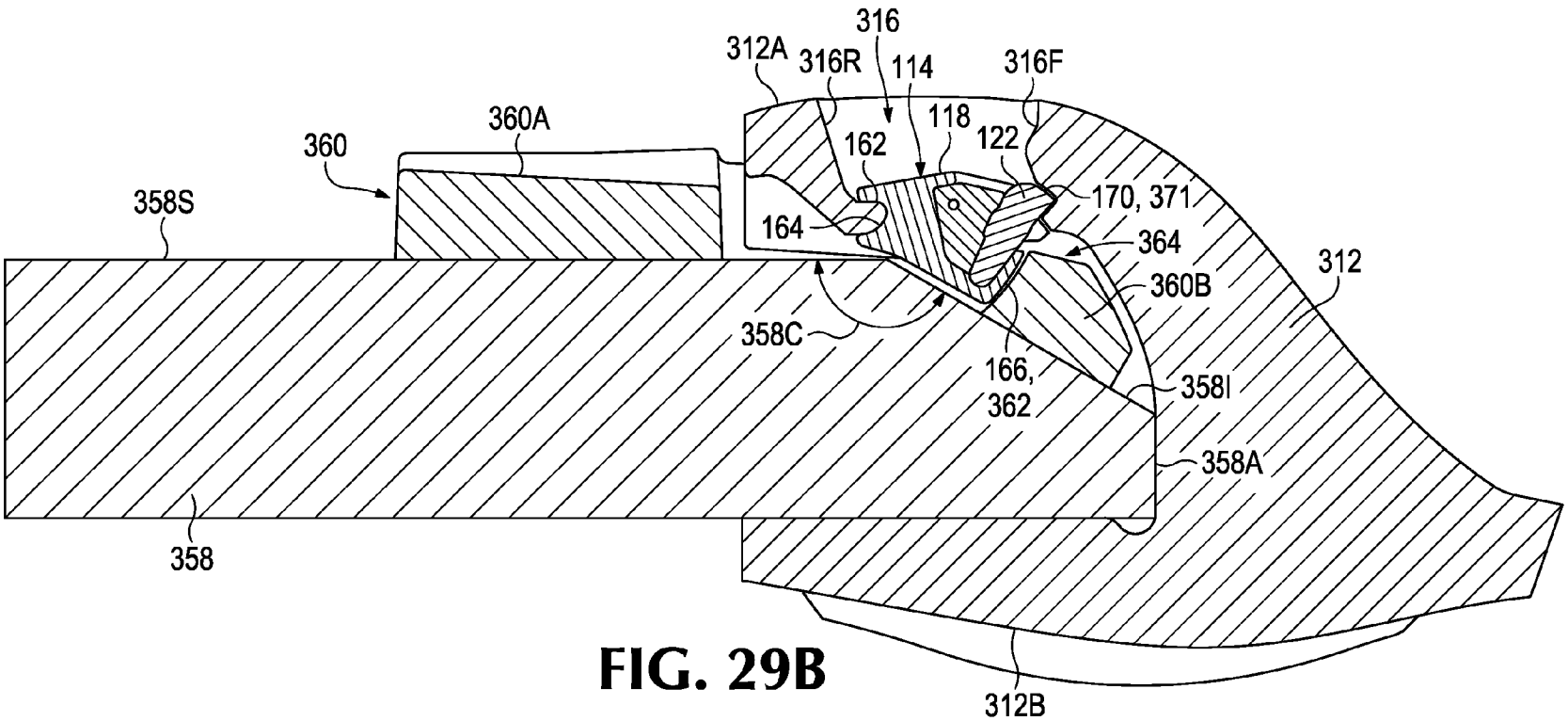
FIG. 29B is a cross sectional view along lines 29B-29B of FIG. 29A.
Figure 29C:
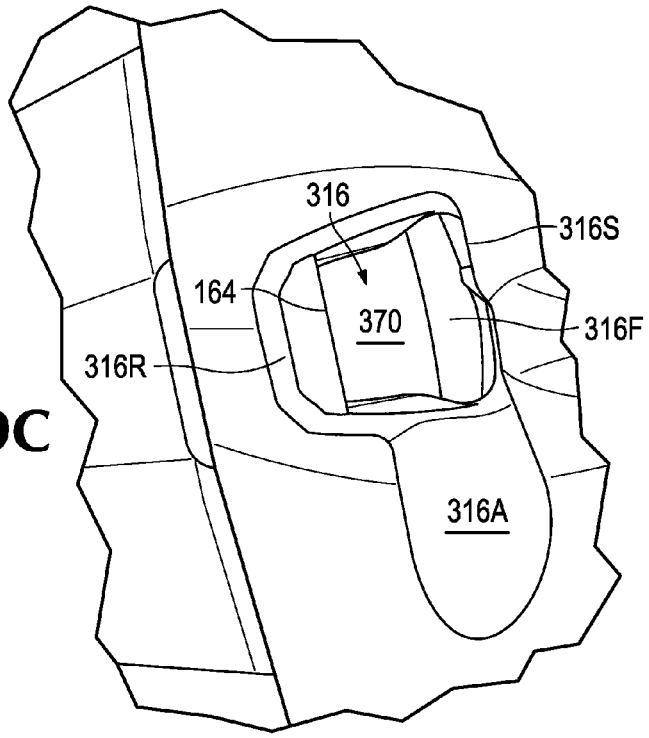
FIGS. 29C and 29D show top and bottom views, respectively, of this example shroud and its lock recess area and boss engagement area.
Figure 29D:
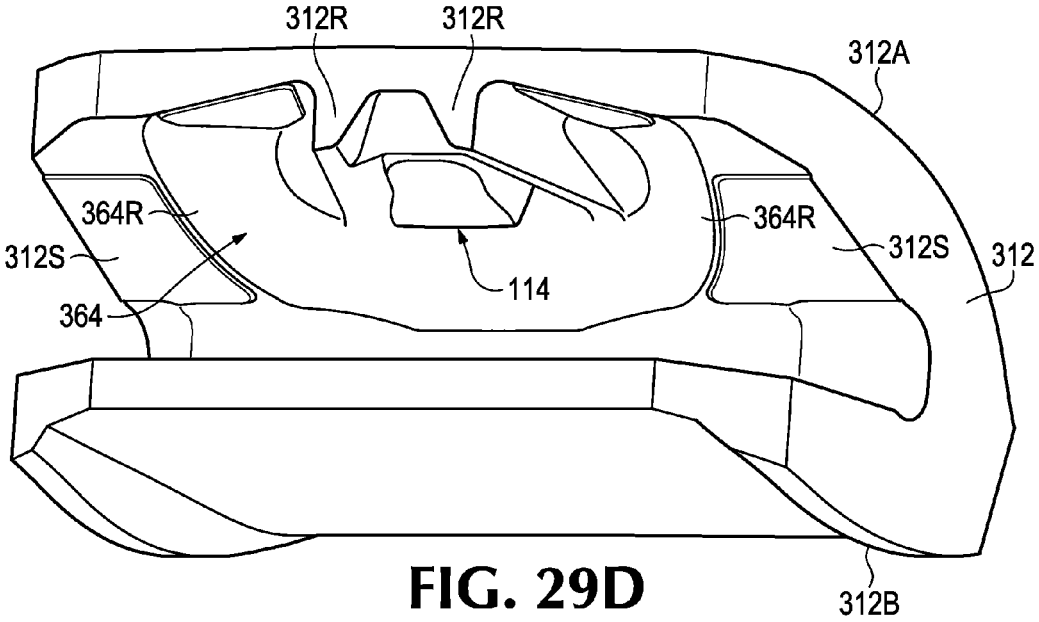
Figure 29E:
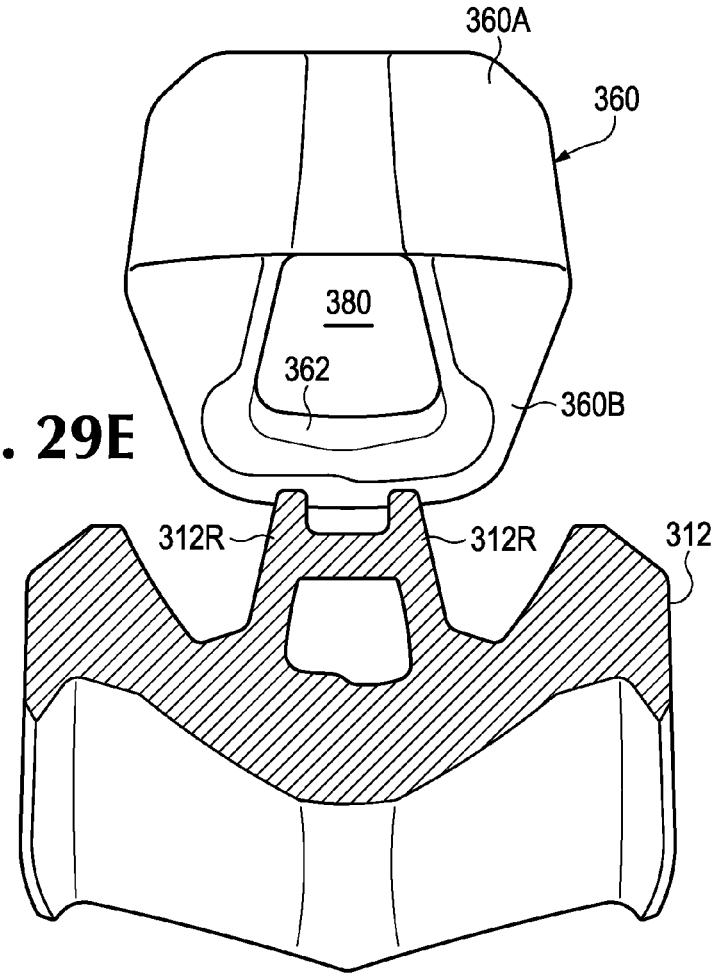
FIGS. 29E and 29F illustrate engagement of this shroud with other wear assembly equipment.
Figure 29F:
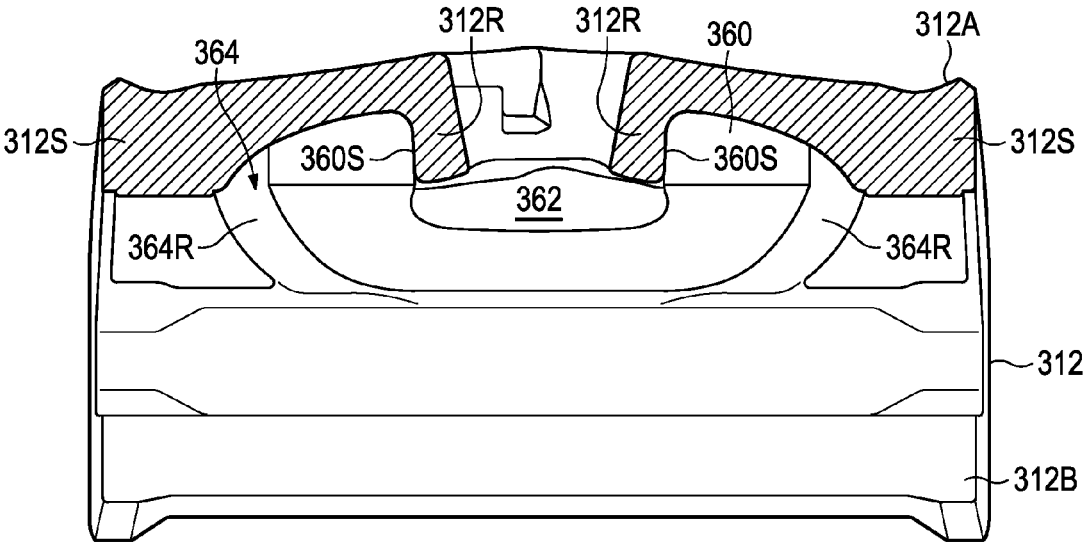

FIGS. 29A through 29F illustrate another example shroud type wear member 312 with which a lock 114 of the type described above may be used to engage the shroud 312 with a base member 358 (such as a lip). FIGS. 29A and 29B show the wear member 312 and the base 358 with the lock 114 engaged therein, and FIG. 29C shows various features of the lock recess 316 of the shroud 312 in more detail. FIG. 29D is a bottom perspective view showing features of the interior of the shroud 312. FIGS. 29E and 29F show features of engagement of this shroud 312 with a boss 360 mounted (e.g., welded) to a base member (e.g., a lip). As shown in these figures, the lock recess 316 is provided on a top leg 312A of the shroud 312 (which also includes a bottom leg 312B that extends rearward about the same distance as the top leg 312A). The shroud 312 of this example is somewhat shorter and more compact in the front-to-rear direction as compared to the shroud 212 of FIGS. 28A through 28E described above.

In this illustrated example structure, the front edge of the base 358 may be equipped with a boss 360 for engaging a shroud (e.g., secured to the base member 358 by welding (or cast as part of the base), but it may be secured in other manners, if practical and desired, such as by mechanical connectors). In this illustrated example, and as best shown in FIG. 29B, the boss 360 is mounted preferably on the ramp portion 358C of the base member 358. Thus, the boss 360 has an angle at its front (matching the angle of ramp portion 358C) such that a rear portion 360A of the boss 360 is welded to the major top surface 358S of the base member 358 and a front portion 360B of the boss 360 is welded to the inclined ramp surface 3581 at the front of base member 358 (the boss 360 also may be welded to the base member 358 along its sides and/or around its entire perimeter). This angled boss 360 provides a secure engagement with base member 358 (e.g., partially held by corner 358C) and allows the shroud 312 to be mounted more forward on the base member 358 (as compared to the boss 260 of FIGS. 28A through 28D, which was mounted solely on the major, horizontal base surface of base member 258 in the orientation shown in FIG. 28B). The boss 360 could be formed as two or more separate pieces or portions.

As shown in FIGS. 29B, 29D, and 29F, the underside of the top leg 312A of this example shroud 312 includes a recessed channel 364 that slides over and partially around the boss 360. The outer edges of recessed channel 364 are defined by side rails or walls 364R that join or converge toward the front of the underside of top leg 312A. These rails 364R define outer edges of a "bowl" type recessed channel 364 for receiving the forward portion of the boss 360. These rails 364R, though, are not intended to generally bear against the opposing surfaces on the boss 360. Additionally, the material of the shroud 312 is thicker outside these rails 364R (e.g., in areas 312S, toward the sides of the shroud 312). This thicker material 312S and rails 364R provide additional strength and improved durability, particularly toward the end of the useful life of the shroud 312.

Further, as shown in FIGS. 29D through 29F, the underside of top leg 312A includes two generally rearwardly extending rails 312R (that taper or converge together in the front-to-rear direction, in this illustrated example structure). These rails 312R are located inside rails 364R and are located inside and contact the sidewalls 360S of the opening 380 in the boss 360. Contact or bearing force between these components 312R and 360S help prevent side-to-side motion of the shroud 312 on the base member 358 during use. Also, the combination of the rails 312R and the boss 360 (including its engagement within the recessed area 364 between outer rails 364R) helps provide improved wear strength of the wear member 312 in the area of the lock 114 and isolation of the lock 114 from uncontrollable, non-centerline loading. This overall construction also helps protect the lock 114 from contact with dirt or other materials during use.

As best shown in FIG. 29B, in the locked configuration, front surface 166 of lock 114 engages a corresponding front bearing surface 362 on the boss 360 to prevent the shroud 312 from pulling away from the front edge 358A of the base member 358. These same surfaces 166 and 362, along with interaction between the anchor feature 162 of the lock body 118 and the support 164 at the rear wall 316R of the lock recess 316 prevent horizontal movement of the lock 114 with respect to the shroud 312 and the base member 358. The anchor 162 may have a rounded recess and the support 164 may have a rounded cross sectional shape, e.g., like components 62 and 64 described in more detail above. Interaction between the anchor feature 162 of the lock body 118 and the support feature 164 at the rear wall 316R of the lock recess 316 along with interaction between the latch 122 shoulder 170 and bearing surface 371 of the shroud 312 prevent ejection of the lock 114 from the lock recess 316 in the vertical direction (with respect to the orientation shown in FIG. 29B).

Features of the lock recess 316 will be described in more detail below. As shown in FIGS. 29A and 29C, the side area of the top leg 312A includes a cut out entry port or recessed area to allow access for a tool (e.g., tool 30, 130) to rotate the actuator member 120 of lock 114. Because of the angled orientation of the actuating axis A with respect to the latching axis B and/or the locking axis C as described above, the bottom surface 316A of this entry port area may be angled somewhat upward and/or away from the top major surface 358S of the base member 358. These angling features can provide more room for operation of the tool 130 (i.e., because the tool 130 handle will be raised somewhat higher above the surface 358S of base member 358 as compared to the location of the handle if the tool extended away from the actuator 120 in a horizontal manner or in a direction substantially parallel to surface 358S). These angling features also allow a manufacturer to provide a greater thickness of shroud material below the bottom surface 316A of the tool insert port, which can help provide longer life and greater resistance to cracking or failure at the lock entry port area.

The entry port area of this example shroud 312 opens into a lock receiving opening 370, a portion of which extends completely through the top leg 312A. This lock receiving opening 370 allows a portion of the lock 114 to extend through the shroud 312 and into position to engage the boss 360 (e.g., as shown in FIGS. 29B and 29D).

As noted above, the support feature 164 at the rear wall area 316R of the lock recess 316 may have a rounded cross sectional shape and the anchor 162 forms a partially rounded opening for receiving support 164 in a rotatable manner, e.g., like components 62 and 64 described in more detail above. Although it need not do so, in this illustrated example structure, this support 164 extends across the entire rear width of lock receiving opening 370 and juts forward from the rear wall 316R. If desired, the support 164 could be provided across just a portion of the rear wall 316R in the side-to-side direction (e.g., a central portion, a portion offset to one side or the other, etc.) or the support 164 could be provided at multiple separated locations across the back of the lock receiving opening 370. Also, if desired, the rounded cross sectional complementary feature (e.g., like support 164) could be provided on the lock body 118 and the groove that receives this feature (e.g., like groove 162) could be provided as part of the back wall of the lock receiving opening 370.

The front wall 316F of the lock recess 316 includes a rearward extending portion 316S that is flush or contiguous with the top surface of leg 312A, but this rearward extending portion 316S is undercut to provide the bearing surface 371 for engaging the shoulder 170 of latch 122 (e.g., see FIG. 29B). An undercut bearing surface also is provided under rearward extending portion 316S for engaging the latch tooth 156 when the lock 114 is mounted to the shroud 312 in a first position, e.g., as described above in conjunction with FIG. 12. The rearward extending portion 316S of the front wall 316F and the undercut areas relating to it may extend any desired proportion of the width of the lock receiving opening 370, but in this illustrated example, these features extend along approximately 25% to 60% of the overall hole 370 width.

While FIGS. 29A through 29F illustrate a shroud 312 engaged with a base member 358 via a welded on (or otherwise attached) boss 360, a separately-formed boss may be omitted, if desired. For example, if desired, the top surface of base member 358 could be formed to include a boss with the surfaces for engaging the lock 114 (e.g., either built up on the top surface or recessed into the top surface of base member 358).

As noted above and as is evident from FIGS. 29A and 29B, in this example overall wear assembly structure, the wear member (i.e., shroud 312) is mounted more toward and on the inclined surface 3581 of the base member 358, as least as compared to the shroud 212 of FIGS. 28A through 28E. This feature makes the wear member 312 somewhat more compact (e.g., shorter in the front-to-back direction as the extended portion 212C of top leg 212A is omitted), and therefore may be made somewhat lighter. Also, this feature makes the shroud 312 somewhat easier to mount on and disengage from a base member as compared to shroud 212 because shroud 312 need not be moved over the longer distances needed to slide an extended portion 212C of its top leg around an edge of and along a base member.

The lock 114 according to the invention as described in conjunction with FIGS. 26A through 29E also has advantages when engaged with a shroud (e.g., 212 or 312) in that the lock 114 can typically be operated relatively easily, even in the field (e.g., also having the advantages of lock 14 described above). As some more specific examples, the lock 114 can be accessed from the sides of the shrouds 212 and 312 as described above but still rotated out of the lock recesses 216, 316 from the top (because the lock recesses 216, 316 remain open at their tops. This arrangement allows for improved access to and interactions with the lock, as well as improved fines cleanout (e.g., from the lock recess area).

The locks of the present invention possess an integrated lock mechanism that may be hammerless and can be installed and removed using standard tools. The operation of the lock is simple and straightforward, and requires only minimal human effort, even in the presence of fines and other debris. Further, the correct installation of the locks is readily visually confirmed, because tab 32, 132 will be to the left or clockwise side of lock recess 16, 116 when latched, and tab 32, 132 will be to the right or counter-clockwise side of lock recess 16, 116 when unlatched.

As those skilled in the art appreciate, because of the environment in which they are used, locks on excavating equipment are exposed to very extreme and harsh conditions. Over time, the locks and the recesses in which they are received may become packed with dirt, grit, and other material (also called "fines" herein). These fines can become so tightly packed in any spaces of locks that it can be difficult to actuate moving parts of the locks when it becomes necessary to do so. Wear assemblies according to the examples of the invention described above, however, still can move relatively easily, even after extended use. The manner in which the latch member 22, 122 and other parts of the locks 14, 114 cooperate or pull away from packed in fines during the unlocking and unlatching phases of motion helps assure that the lock 14, 114 can be operated even after prolonged exposure to the harsh environment.

It should be appreciated that although the embodiments of the representative latch mechanism disclosed herein utilize three components, a greater or lesser number of components may be readily envisioned that are similarly suitable for forming a latch mechanism of the present invention. Although multi-component latch mechanisms may facilitate assembly of the lock during manufacture, fewer lock components may be used to simplify design and reduce the complexity of the lock. For example, the individual actuating member and latch member may be replace by a single lock component that serves as both actuating member and latch member. As another example, other biasing means may be provided in place of the resilient member.

It is believed that the disclosure set forth herein encompasses multiple distinct inventions with independent utility. While each of these inventions has been disclosed in its preferred form, the specific embodiments thereof as disclosed and illustrated herein are not to be considered in a limiting sense as numerous variations are possible. Each example defines an embodiment disclosed in the foregoing disclosure, but any one example does not necessarily encompass all features or combinations that may be eventually claimed. Where the description recites "a" or "a first" element or the equivalent thereof, such description includes one or more such elements, neither requiring nor excluding two or more such elements. Further, ordinal indicators, such as first, second or third, for identified elements are used to distinguish between the elements, and do not indicate a required or limited number of such elements, and do not indicate a particular position or order of such elements unless otherwise specifically stated.

We claim:

1. A wear member for ground-engaging equipment comprising an exterior surface to contact earthen material, an interior surface facing and contacting a base on the equipment to secure the wear member to the equipment, and a hole extending from the exterior surface to the interior surface, the hole having a rear wall with a support projecting forwardly into the hole for a lock to engage and swing inward to engage the base and hold the wear member to the equipment and swing outward to release the base and permit release of the wear member from the equipment, and the hole having a front wall opposite the rear wall, the front wall having an outer portion extending from the exterior surface toward the interior surface, and an inner portion between the outer portion and the interior surface forming a pocket recessed forwardly into the wear member with respect to the outer portion and open to the interior surface for receiving a latch portion of the lock to retain the lock in the inwardly swung position.

2. A wear member according to claim 1 including a lock access recess in the exterior surface to accommodate insertion of a tool to engage and operate the lock, the lock access recess extending away from the hole and generally between the front and rear walls.

3. A wear member according to claim 2 having a rearwardly-opening cavity for receiving the base, the cavity being defined by a top wall, a bottom wall and spaced sidewalls extending between the top and bottom walls, the hole extending through at least one of the sidewalls, and the lock access recess extending from the hole to at least one of the top and bottom walls.

4. A wear member according to claim 2 having first and second legs spaced to straddle the base, the first leg having an outer surface and a pair of opposite side surfaces extending between the outer surface and the base, the outer surface and the side surfaces defining a portion of the exterior surface, the hole being defined to open in the outer surface of the first leg, and the lock access recess extending from the hole to one of the side surfaces.

5. A wear member according to claim 4 wherein the first leg has an inner surface defining a portion of the interior surface and facing the base, a rear end wall, and a slot opening in the inner surface and the rear end wall to receive the base.

6. A wear member according to claim 5 wherein the slot is partially defined by a pair of interior sidewalls to face opposite sides of the base, and the interior sidewalls converge in a direction away from the rear end wall.

7. A wear member according to claim 1 including a rear end wall, and a slot opening in the interior surface and the rear end wall to receive the base.

8. A wear member according to claim 7 wherein the slot is partially defined by a pair of interior sidewalls to face opposite sides of the base, and the interior sidewalls converge in a direction away from the rear end wall.

9. A wear member according to claim 1 wherein the support is longer in a direction extending along the rear wall than the forward projection of the support from the rear wall.

10. A wear member according to claim 1 wherein the support is adjacent the interior surface and spaced from the exterior surface.

11. A wear member according to claim 1 wherein the support has a rounded front end and a generally flat, axially-extending outer surface.

12. A wear member according to claim 1 wherein the hole includes a first wall extending between the front wall and rear wall, a lock access recess extends from a side of the hole opposite the first wall and in a direction away from the first wall, wherein the lock access recess is defined in the exterior surface but does not extend through to the interior surface of the wear member.

13. A wear member according to claim 1 including a first leg and a second leg opposite the first leg, the hole is defined in the first leg, the first leg includes a first rail and a second rail extending rearward toward a rear end wall of the first leg, and the first and second rails each have a side surface to bear against complementary surfaces on the base.

14. A wear member according to claim 13 wherein the first and second rails axially converge in a direction toward the rear end wall.

15. A wear member according to claim 13 wherein the hole is provided between the first rail and the second rail.

16. A wear member according to claim 13 including a lock access recess extending in a direction away from the hole, wherein the lock access recess extends over the first rail.

17. A wear member according to claim 1 wherein the interior surface includes a first rail and a second rail extending rearward toward a rear end wall, the first and second rails each have a side surface to bear against complementary surfaces on the base, and the side surfaces face away from each other.

18. A wear member according to claim 17 wherein the first and second rails axially converge in a direction toward the rear end wall.

19. A wear member according to claim 18 wherein the hole is provided between the first rail and the second rail.

20. A wear member according to claim 19 including a lock access recess in the exterior surface extending in a direction away from the hole, wherein the lock access recess extends over the first rail.

21. A wear member according to claim 1 including a lock received into the hole, the lock including a rear end with a recess adapted to receive the support and a front end with a latch, the lock being swingable between a first position where the lock contacts the base to secure the wear member to the equipment and a second position where the lock releases the base, and the latch being movable to engage the front wall of the hole to secure the lock alternatively in the first and second positions.

22. A wear member according to claim 1 wherein the wear member is a shroud having a pair of rearwardly extending legs to straddle the base, and a front working end to contact earthen material.

23. A wear member according to claim 1 wherein the wear member is a point having a rearwardly opening cavity to receive the base, and a narrowed front edge to penetrate the ground in a digging operation.

24. A wear assembly for ground-engaging equipment comprising:

a base secured to the equipment;

a wear member for ground-engaging equipment comprising an exterior surface to contact earthen material, an interior surface facing and contacting a base on the equipment to secure the wear member to the equipment, and a hole extending from the exterior surface to the interior surface, the hole having a rear wall with a support projecting forwardly into the hole for a lock to engage and swing inward to engage the base and hold the wear member to the equipment and swing outward to release the base and permit release of the wear member from the equipment, and the hole having a front wall opposite the rear wall, the front wall having an outer portion extending from the exterior surface toward the interior surface, and an inner portion between the outer portion and the interior surface forming a pocket recessed forwardly into the wear member with respect to the outer portion and open to the interior surface for receiving a latch portion of the lock to retain the lock in the inwardly swung position; and a lock engaged in the hole and including a front end having a movable latch member that contacts the wear member, and a rear end having a recess for engaging the support.

* * * * *